US010184757B1

(12) United States Patent
Ahlgren et al.

(10) Patent No.: US 10,184,757 B1
(45) Date of Patent: Jan. 22, 2019

(54) POSITIONING DEVICE FOR ALIGNMENT OF ARCHERY SIGHT

(71) Applicant: Garmin Switzerland GmbH, Schaffhausen (CH)

(72) Inventors: Austin W. Ahlgren, Lenexa, KS (US); Christopher G. Perra, Kansas City, MO (US); Jonathan E. Reberry, Overland Park, KS (US); Brian F. Ruff, Olathe, KS (US)

(73) Assignee: Garmin Switzerland GmbH (CH)

( * ) Notice: Subject to any disclaimer, the term of this patent is extended or adjusted under 35 U.S.C. 154(b) by 0 days.

(21) Appl. No.: 16/026,208

(22) Filed: Jul. 3, 2018

Related U.S. Application Data

(60) Provisional application No. 62/529,312, filed on Jul. 6, 2017.

(51) Int. Cl.
*F41G 1/54* (2006.01)
*F41G 1/467* (2006.01)

(52) U.S. Cl.
CPC ..... *F41G 1/545* (2013.01); *F41G 1/467* (2013.01)

(58) Field of Classification Search
CPC ..... F41G 1/467; F41G 1/545
(Continued)

(56) References Cited

U.S. PATENT DOCUMENTS 3,590,489 A 7/1971 Saunders
4,195,414 A 4/1980 Robinson
(Continued)

OTHER PUBLICATIONS

Inter Partes Review No. IPR2018-01137 of U.S. Pat. No. 8,316,551, Petition for Inter Partes Review of U.S. Pat. No. 8,316,551B2, May 29, 2018.

(Continued)

*Primary Examiner* — Yaritza Guadalupe
(74) *Attorney, Agent, or Firm* — Samuel M. Korte; Max M. Ali

(57) ABSTRACT

Systems and methods for a positioning device for alignment of archery sights are disclosed. According to one embodiment of the disclosure, an assembly for mounting a bow sight to a bow may be disclosed. The bow sight may project a fixed sighting mark and a laser sighting reticle that may be aligned to orient a bow. The assembly may include: a mount that may be operable to attach to a riser of the bow, a translational block coupled to the mount that may be operable to align the fixed sighting mark along a sighting line. The translational block may further include: a first translational element that may be operable to adjust a location of the fixed sighting mark along a first axis of translation. The assembly may further include a rotational block that may be operable to align the laser sighting reticle along the sighting line. The rotational block may further include: a first angular element that may be operable to adjust a pitch of the bow sight to move a position of position of the laser sighting reticle about a first axis of rotation, wherein a center of rotation of the pitch is the fixed sighting mark, and a second angular element that may be operable to adjust a yaw of the bow sight to move the position of the laser sighting reticle about a second axis of rotation, wherein a center of rotation of the yaw is the fixed sighting mark.

20 Claims, 26 Drawing Sheets

(58) Field of Classification Search
USPC ..... 33/265
See application file for complete search history.

(56) References Cited

U.S. PATENT DOCUMENTS

| | | | | |
|---|---|---|---|---|
| 5,425,177 | A | 6/1995 | Pacenti | |
| 5,634,278 | A | 6/1997 | London | |
| 5,914,775 | A | 6/1999 | Hargrove et al. | |
| 6,079,111 | A | 6/2000 | Williams et al. | |
| 6,446,347 | B1 | 9/2002 | Springer | 33/265 |
| 7,721,453 | B1 | 5/2010 | Young | 33/265 |
| 8,316,551 | B2 | 11/2012 | Gorsuch et al. | |
| 8,739,419 | B1 * | 6/2014 | Pulkrabek | F41G 1/467 124/87 |
| 9,513,085 | B2 * | 12/2016 | Hahn | F41G 1/033 |
| 2004/0031162 | A1 | 2/2004 | Rager | 33/265 |
| 2007/0028467 | A1 | 2/2007 | Bradley et al. | 33/265 |
| 2011/0167655 | A1 * | 7/2011 | Pulkrabek | F41B 5/14 33/228 |
| 2012/0102767 | A1 * | 5/2012 | Pulkrabek | F41B 5/14 33/228 |
| 2013/0174431 | A1 * | 7/2013 | Pulkrabek | F41G 1/467 33/228 |
| 2016/0169623 | A1 * | 6/2016 | Finley | F41B 5/1469 124/87 |
| 2018/0010888 | A1 * | 1/2018 | Finley | F41G 1/467 |

OTHER PUBLICATIONS

U.S. Pat. No. 8,316,551, File History dated Nov. 9, 2009 to Nov. 7, 2012.

Inter Partes Review No. IPR2018-01137 of U.S. Pat. No. 8,316,551, Declaration of Dr. Bill Cross, May 29, 2018.

Horace Alfred Ford and W. Butt, The Theory and Practice of Archery, Longman, Greens, and Co. (1887).

Gao Ying, The Way of Archery (first published in 1637), as translated in Jie Tan and Justin Ma, The Way of Archery: A 1637 Chinese Military Training Manual, Schiffer Publishing Ltd. (2014).

International Search Report and Written Opinion for corresponding PCT/US2018/040696, filed Jul. 3, 2018.

* cited by examiner

POSITIONING DEVICE FOR ALIGNMENT OF ARCHERY SIGHT

RELATED APPLICATIONS

The present application claims the benefit under 35 U.S.C. § 119(e) of U.S. Provisional Application Ser. No. 62/529,312, entitled "Positioning Device for the Alignment of Targeting Pins," filed Jul. 6, 2017. The above-referenced Provisional Application is herein incorporated by reference in its entirety.

BACKGROUND

Projectile weapons, such as a bow and arrow, include or may be used with a sight (also referred to as a bow sight) that aids a user with identifying the target. Bow sights that contain a targeting pin may need to be aligned by a user to provide a targeting reference. Accuracy of the projectile weapon may largely depend on accurate alignment of the targeting pin. The targeting pin may be aligned by conventional positioning devices for alignment in three degrees of translation—laterally (left to right), vertically (up and down), or by distance (front to back). While the translational adjustments enabled by conventional positioning devices may ensure that the targeting pin is aligned in translation, the conventional positioning devices may result in an angular misalignment of a second pin. For instance, an angular misalignment of a second pin might result in shots consistently landing on one side of an intended target because of misalignment of a roll of the bow sight, or shots angled down from a tree consistently landing on one side of an intended target because of misalignment of a yaw of the bow sight, or when a bow sight bore presents itself at an angle to the user due to misalignment of a pitch of the bow sight. Any angular adjustments made to fix one or more of the above angular misalignment of the second pin may create a translational error for the targeting pin (fixed sighting mark) leading the user to have to re-align the fixed sighting mark after said angular adjustments.

BRIEF DESCRIPTION OF THE DRAWINGS

The detailed description is described with reference to the accompanying figures. The use of the same reference numbers in different instances in the description and the figures may indicate similar or identical items. Various embodiments or examples ("examples") of the present disclosure are disclosed in the following detailed description and the accompanying drawings. The drawings are not necessarily to scale. In general, operations of disclosed processes may be performed in an arbitrary order, unless otherwise provided in the claims.

DETAILED DESCRIPTION

Overview

Figure 1A:
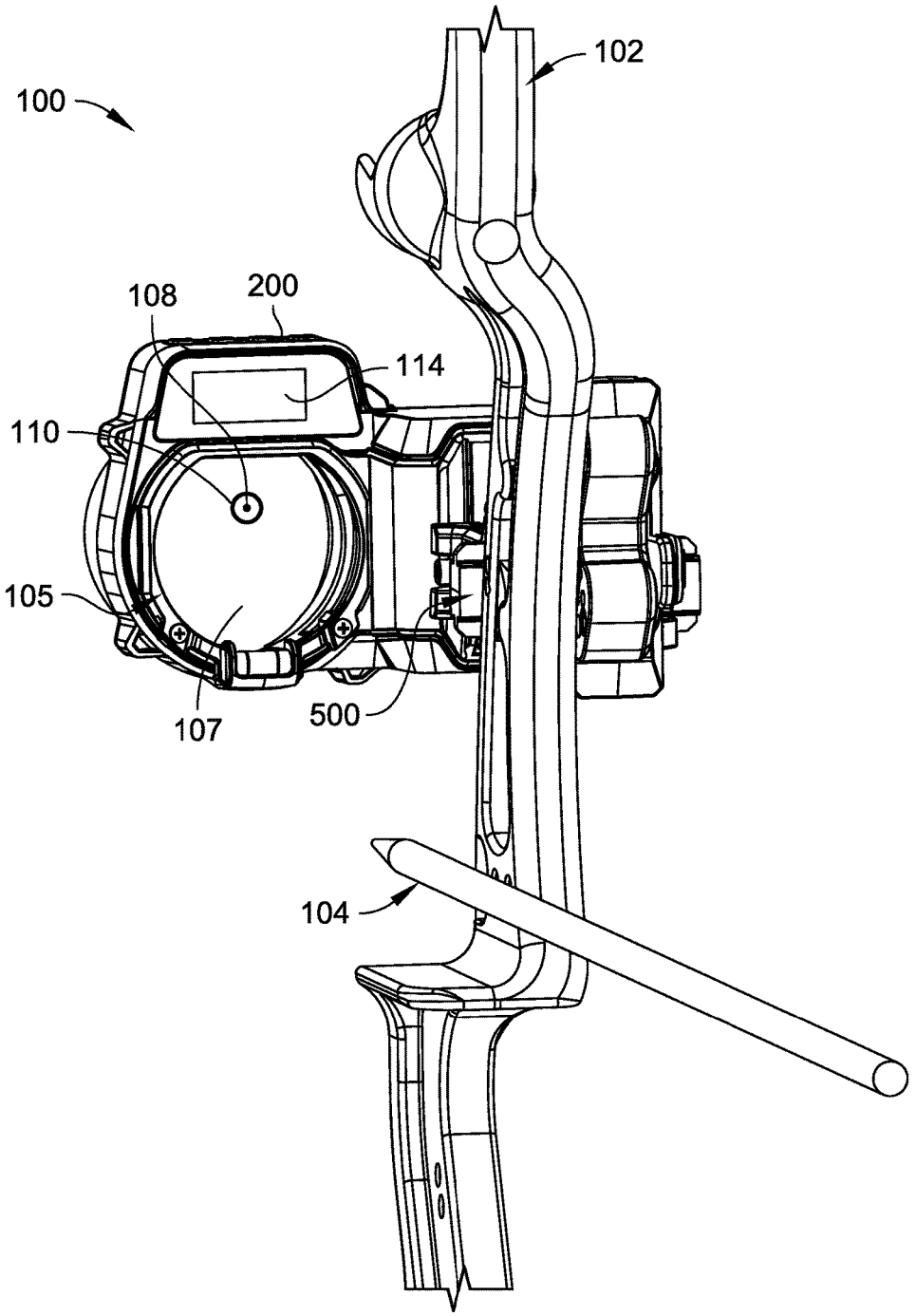
FIG. 1A is a perspective view of a targeting system secured to a bow with a mounting assembly.

The following text sets forth a detailed description of numerous different embodiments. Various bows utilize sights to assist an operator with aligning the bow to aim an arrow at a target and strike the target with the arrow. Bow sights that use a projected pin or a projected image to assist in sight alignment (also referred to as holographic sights) may provide a projected pin or image that appears to float in space. For instance, the projected pin or image may appear to a user positioned behind the bow sight as floating either in front or behind the sight. The projected pin or image is typically used for aligning the bow with a desired target for ranging and aiming. A projected pin may be adjusted using one or more translations, such as laterally (left to right), vertically (up and down), or by distance (front to back), or angular adjustments to the bow sight, such as changes in pitch, roll or yaw.

The projected pin or image, in some cases, may be a fixed sighting mark (targeting pin) and/or a laser sighting reticle that is presented to the operator as overlaid along a sighting line to a target through the bow sight. When determining a range to a target, a sighting line (or line of sight from a user's eye to an intended target) aligned for a user to properly orient their bow to a target may be aligned with both the fixed sighting mark and the projected image (or laser sighting reticle) along the sighting line. For ranging a target, an illuminated display surface may present or project a fixed sighting mark and/or a laser sighting reticle for use with ranging to the target, but the projection may appear to move as the orientation and position (frame-of-reference) of the bow sight changes. The frame of reference of the bow sight assembly may impact a position at which the fixed sighting mark and/or laser sighting reticle are presented or projected. As a result, small movements of the bow sight in pitch or yaw angles may cause the fixed sighting mark or the laser sighting reticle to shift substantially. If the location of the fixed sighting mark is aligned using translational adjustments before the laser sighting reticle is aligned, any angular adjustments to the laser sighting reticle may cause misalignment of the fixed sighting mark along the sighting line. Inversely, if the location of the laser sighting reticle is aligned using translational adjustments before the fixed sighting mark is aligned, any angular adjustments to the fixed sighting mark may cause misalignment of the laser sighting reticle along the sighting line.

Many conventional bows include a peep sight that is attached to or incorporated within bow string to aim at a target using a pin or LED in a target sighting window of a conventional scope attached to the bow. The peep sight typically forms a small, circular opening through which a target sighting window, which includes a calibrated pin or LED, and a target scene including the target is viewed by the user. The typical location of the peep sight on the bow string requires the bow to be fully drawn (the bow string is pulled by the user to an anchor point in the fully drawn position) and thus limits its use to that position. As a result, use of a peep sight helps establish an aiming sight line (a line of sight) extending through the peep sight and the target sighting window to align a target with a pin or LED in the target sighting window when viewed from a user's eye position. Although the peep sight may be positioned close to the user's eye, even slight movement or rotation of the user in the fully drawn position may cause misalignment of the bow and result in errant ranging or shot of the arrow.

Similarly, many conventional rifles integrate on a top surface of the rifle a front sight and a rear sight, both of which are aligned by the user when aiming the rifle at a desired target. Typically, one of the rifle sights is a vertical post and the other rifle sight is shaped such that it has a central U-shaped or V-shaped opening through which the user looks to align the rifle properly to strike a desired target. The two sights on a top surface of a rifle, or any projectile weapon, enable a user to properly orient the rifle because the sight points serve as two points that align the user's aiming sight line to the barrel of the rifle. Some rifle sights include a projector engine operable to output a holographic image that projects one or more sighting elements onto a surface viewed by a user such that the projected elements appear to be located closer to a target (i.e., the projected sighting elements are projected onto a target plane) when the surface is viewed from a perspective corresponding to a user's eye position.

To aid with properly aiming at a target for determining a range to the target, some conventional targeting systems include a target sighting window including a reticle or a ranging module including a laser diode operable to output light (e.g., a laser) on a desired target. For targeting systems that provide information relating to a recommended orientation (e.g., vertical or lateral angular adjustment), it is important that a range is being accurately measured for the desired target instead of a nearby object. Embodiments of the present disclosure describe a system, a mounting assembly and a process that enable a user to precisely range a target using a combination of a laser sighting reticle and a fixed sighting mark presented within a sight with or without requiring use of a peep sight located on a bow string and with or without requiring a laser diode that outputs a visible light on the target.

The fixed sighting mark presented within the sight may be aligned with a sighting line using translational adjustments of translational elements of a mounting assembly that may removably couple (mount) the bow sight to the bow. The mounting assembly may have rotational elements that may enable the user to make angular adjustments to a position of the bow sight such that the laser sighting reticle is oriented with the fixed sighting mark along the sighting line to the target. An example embodiment of the disclosure enables decoupling the rotational elements of the mounting assembly from the translational elements. A technical effect of such a decoupling may be to ensure that translational adjustments performed to align a fixed sighting mark along the sighting line remain fixed when rotational adjustments are made to align the laser sighting reticle with the sighting line. Another technical effect for a user of the projectile weapon may be an increased accuracy of striking an intended target and reducing calibration time.

Systems and methods for a positioning device for alignment of archery sights are disclosed in accordance with example embodiments of the disclosure. According to one embodiment of the disclosure, an assembly for mounting a bow sight to a bow may be disclosed. The bow sight may project a fixed sighting mark and/or a laser sighting reticle that may be aligned to orient a bow. The assembly may include a mount that may be operable to attach to a riser of the bow, a translational block coupled to the mount that may be operable to align the fixed sighting mark along a sighting line. The translational block may further include a first translational element that may be operable to adjust a location of the fixed sighting mark along a first axis of translation. The assembly may further include a rotational block that may be operable to align the laser sighting reticle along the sighting line by rotating the bow sight about a point (e.g., pitch, yaw, roll, etc.). The rotational block may further include a first angular element that may be operable to adjust a pitch of the bow sight to move a position of the laser sighting reticle about a first axis of rotation, wherein a center of rotation of the pitch is the fixed sighting mark, and a second angular element that may be operable to adjust a yaw of the bow sight to move the position of the laser sighting reticle about a second axis of rotation, wherein a center of rotation of the yaw is the fixed sighting mark.

According to another embodiment of the disclosure, a method of orienting a bow may include projecting a fixed sighting mark from a bow sight of the bow and projecting a laser sighting reticle from the bow sight. The method may further include aligning the fixed sighting mark along a sighting line by adjusting a translational block coupled to a mount of a bow sight mounting assembly such that a location of the fixed sighting mark is adjusted along a first axis of translation using a first translational element to align with the sighting line. The method may further include aligning the laser sighting reticle along the sighting line by adjusting a rotational block of the bow sight mounting assembly. Adjusting the rotational block may include moving a position of the laser sighting reticle to adjust a pitch of the bow sight about a first axis of rotation using a first angular element, wherein a center of rotation of the pitch is the fixed sighting mark and may include moving a position of the laser sighting reticle to adjust a yaw of the bow sight about a second axis of rotation using a second angular element, wherein a center of rotation of the yaw is the fixed sighting mark. Thus, the adjusted positioned of the fixed sighting mark and the laser sighting reticle align along the sighting line.

According to another embodiment of the disclosure, a system may include a bow sight attached to a bow, wherein the bow sight may project a fixed sighting mark and a laser sighting reticle. The system may further include an assembly for mounting the bow sight to the bow. The assembly may include a mount that may be attached to a riser of the bow and a translational block coupled to the mount that may be align the fixed sighting mark along a sighting line. The translational block may further include a first translational element that may be capable of adjusting the location of the fixed sighting mark along a first axis of translation. The assembly may further include a rotational block that may be capable of aligning the laser sighting reticle along the sighting line. The rotational block may further include a first angular element that may be capable of adjusting a pitch of the bow sight to move a position of the laser sighting reticle about a first axis of rotation, wherein a center of rotation of the pitch is the fixed sighting mark and a second angular element capable of adjusting a yaw of the bow sight to move the position of the laser sighting reticle about a second axis of rotation, wherein a center of rotation of the yaw is the fixed sighting mark. Furthermore, the translational block may be operationally decoupled from the rotational block so that an adjustment of the rotational block may not change the location of the fixed sighting mark along the first axis of translation (for example, z axis) and the second axis of translation (for example, y axis).

Example Implementations

Embodiments of the disclosure may be described in the attached figures, FIG. 1A through FIG. 24. Referring now to FIG. 1A, embodiments of the disclosure may be used in conjunction with an environment of a system 100. System 100 may include a bow 102 that may be a straight bow, a recurve bow, or a compound bow. System 100 of FIG. 1A shows a bow 102 with a targeting system 200 thereon, as seen from an operator's perspective (with a target positioned on the opposite side of bow 102 and targeting system 200), wherein the targeting system 200 is attached to the bow 102 via a mounting assembly 500.

The targeting system 200 may include a bow sight 105 and may be mounted to the bow 102 above an arrow 104. Targeting system 200 may contain a transparent or semi-transparent target sighting window 107. An object to be targeted using targeting system 200 may be seen by a user through target sighting window 107. The target sighting window 107 may enable the targeting system 200 to present or display one or more sighting marks (such as a fixed sighting mark 108 and a laser sighting reticle 110, each of which is discussed in depth below) used for calibration of targeting system 200 and the targeting of an object of interest. In embodiments, the targeting system 200 may further include an alphanumeric display 114 for the display of information to the operator.

A projector within a housing of the bow sight 105 may be capable of projecting onto the target sighting window 107 a fixed sighting mark 108 and/or a laser sighting reticle 110 that substantially aligns a line of sight 308 to the ranging module transmit axis 312 (discussed below). In an example embodiment of the disclosure, the targeting system 200 may be a standalone device that is secured to the bow 102 using a mounting assembly 500.

Figure 1B:
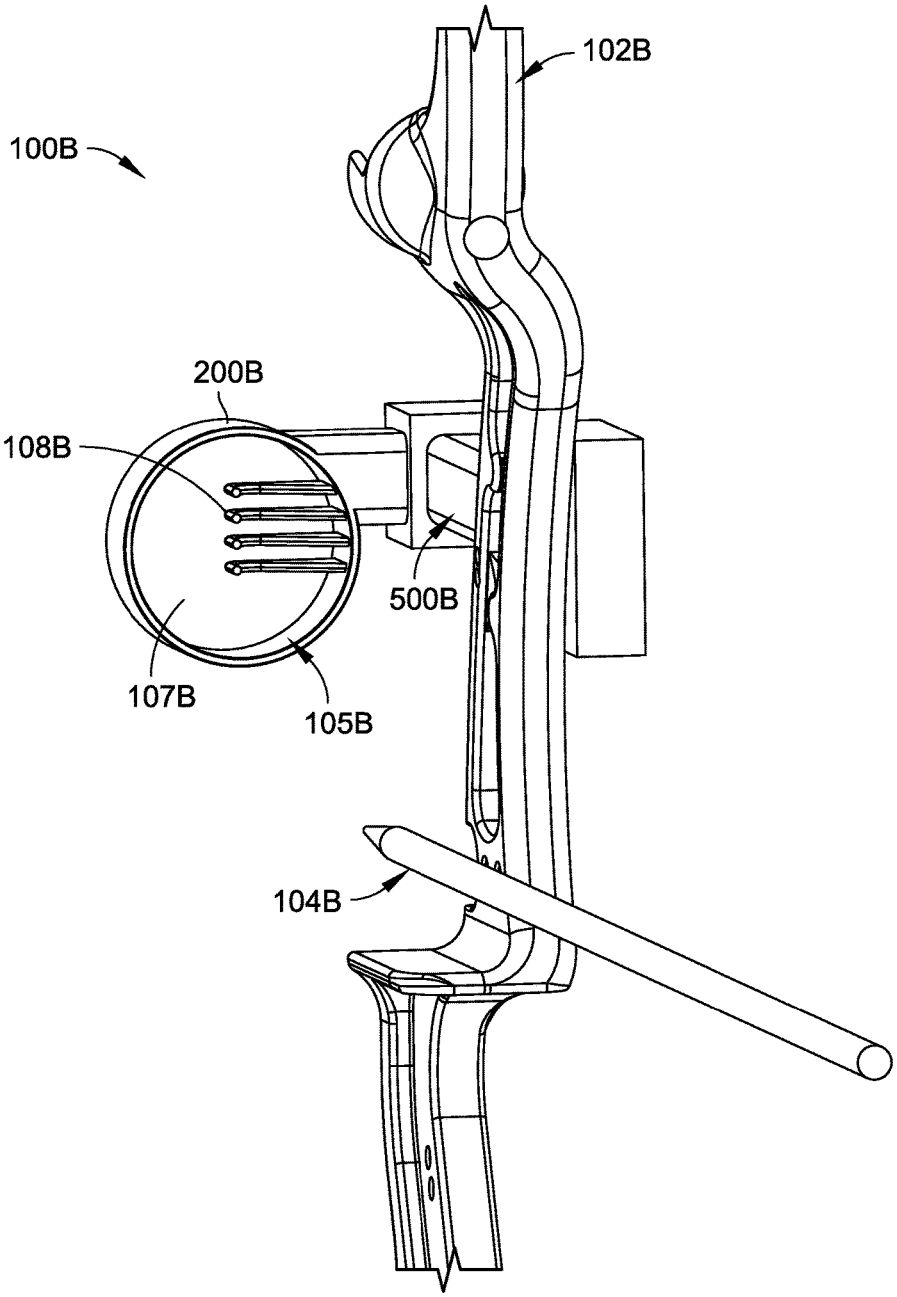
FIG. 1B is a perspective view of a conventional targeting system secured to a bow with a mounting assembly.

FIG. 1B shows a system 100B that may include a bow 102B with a targeting system 200B thereon, as seen from an operator's perspective (with a target positioned on the opposite side of bow 102B and targeting system 200B), wherein the targeting system 200B is attached to the bow 102B via a mounting assembly 500B.

The targeting system 200B may include a bow sight 105B and may be mounted to the bow 102B above an arrow 104. Targeting system 200B may contain a target sighting window 107B. An object to be targeted using targeting system 200B may be seen by a user through target sighting window 107B. The target sighting window 107B include targeting pins used for calibration of targeting system 200B and targeting of an object of interest. In this embodiment, a fixed sighting mark 108B may be part of the targeting pins used for calibration of the targeting system 200B.

Figure 2:
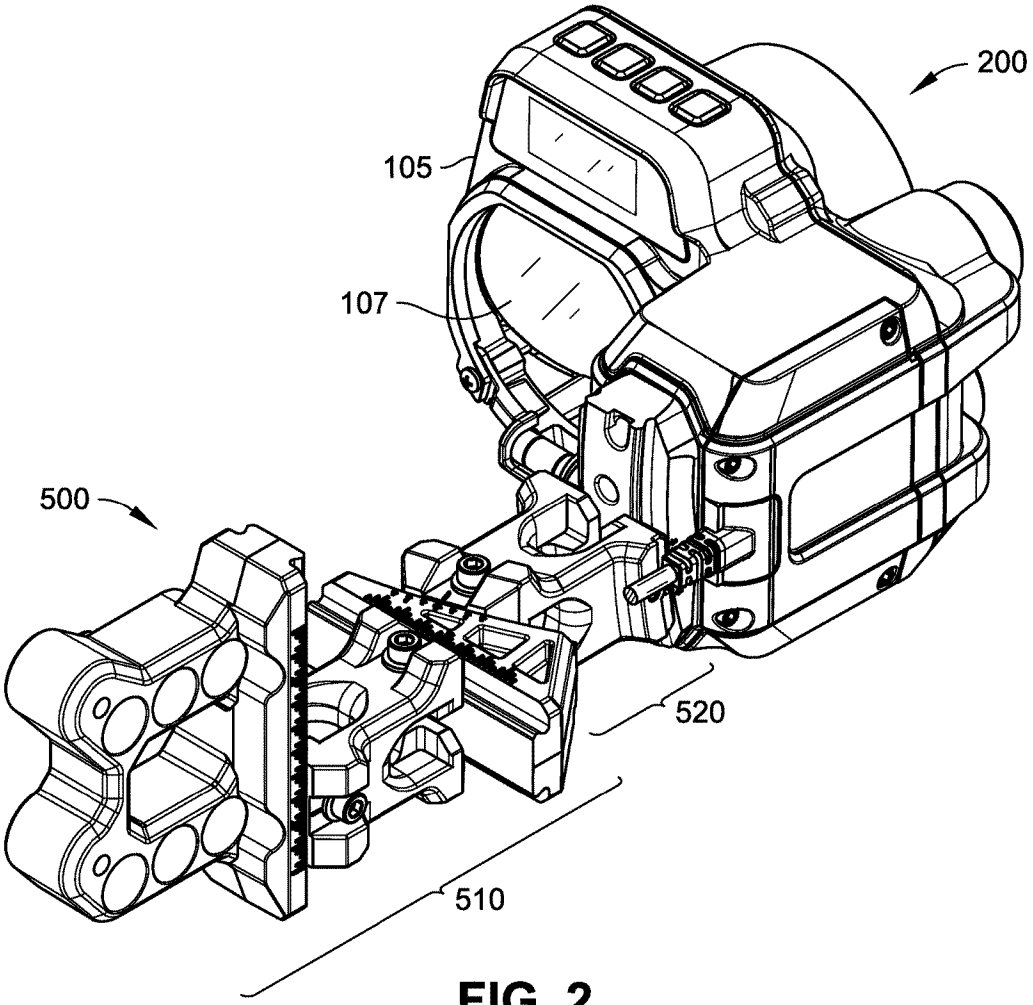
FIG. 2 is an isometric view of the targeting system (bow sight), illustrating an example mounting assembly operable to be adjusted to align the targeting system with the bow.

FIG. 2 shows the targeting system 200 and the mounting assembly 500 detached from the bow 102. In an example embodiment of the disclosure, the mounting assembly 500 may be attached to the bow 102 and couples the targeting system 200 to the bow. The targeting system 200 may include target sighting window 107 as well as various sensors and circuitry to calculate a range from bow 102 to a target 318, determine an orientation of bow 102, or determine environmental conditions (e.g., wind sensor, ambient light sensor, etc.). Targeting system 200 may include a housing formed from a unitary assembly or combined in a semi-permanent configuration containing the components of targeting system 200. The mounting assembly 500 may be adjusted in a variety of manners to enable proper use of targeting system 200 with bow 102. For instance, the mounting assembly 500 may include translation adjustments, angle elevation adjustments (which may be referred to as "pitch"), azimuth adjustments (which may be referred to as "yaw), and/or rotation adjustments (which may be referred to as "roll").

The mounting assembly 500 may also include or couple to a translational block 510 that provides translation of the targeting system 200 along a first axis of translation (for example, a z-axis), a second axis of translation (for example, an x-axis), or a third axis of translation (for example, a y-axis) to align a fixed sighting dot, such as the fixed sighting mark 108, to the line of sight 308. Exemplary components of the translational block 510 shown in FIG. 2A, such as those for vertical adjustments and horizontal adjustment are described later. Further examples could include a rotational block 520, which provides rotation of the targeting system 200 about pitch, yaw or roll axes. A pitch sight adjustment may move the targeting system 200 in a pitch direction, and a yaw sight adjustment may move the targeting system 200 in a yaw direction, and a roll sight adjustment may move the targeting system 200 in a roll direction. It should be appreciated that these adjustments are made relative to the bow 102 onto which the mounting assembly 500 is mounted.

Figure 3:
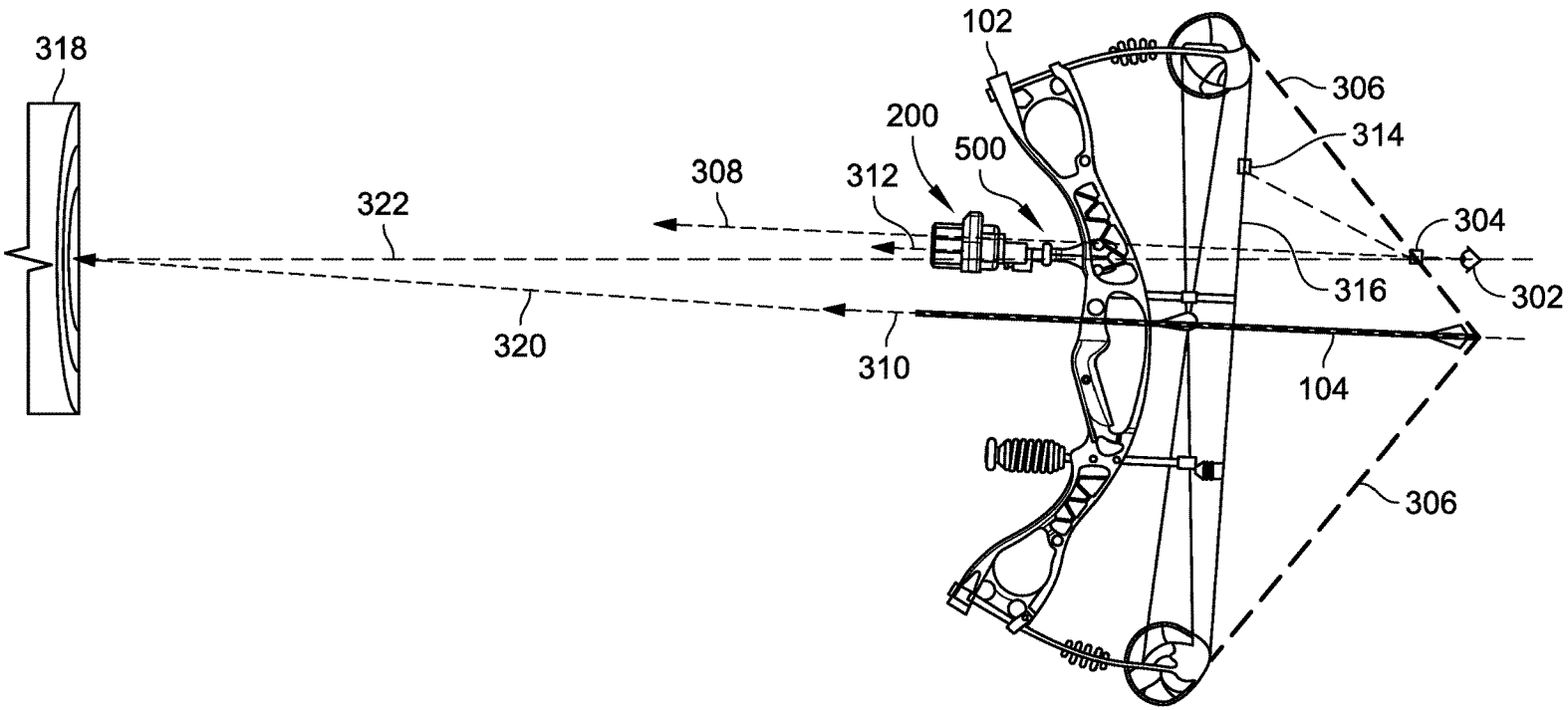
FIG. 3 is a side view of the targeting system, bow, mounting assembly, and a target.

FIG. 3 shows a side view of the bow 102 in both drawn and undrawn positions. A bow string 306, 316 provides an exemplary form of propulsion for arrow 104. Bow string 306 may correspond to bow 102 in the fully drawn position where bow string 306 and arrow 104 have been pulled by the user to an anchor point. Bow string 316 may correspond to bow 102 when in the undrawn position.

The targeting system 200 may be aligned with bow 102 or positioned in front of bow 102 using the mounting assembly 500. The mounting assembly 500 may place the targeting system 200 at a short distance from an eye position 302 of the user when bow 102 is drawn.

In some embodiments, such as bow 102 being a compound bow, a peep sight 304 may be attached to or incorporated within bow string 306. The peep sight 304 may form a small, circular opening through which the target scene and target sighting window 107 are viewed by the user from eye position 302. A line of sight (also called "a sighting line") 308 may extend from eye position 302, through peep sight 304, through the target sighting window 107, to a target 318 while bow 102 is in the drawn position. Movement of peep sight 304 attached to bow string 306 from an unused initial position 314 to a drawn position is illustrated using a broken line.

To help illustrate use of targeting system 200 with the mounting assembly 500, a line of sight 308 may extend from eye position 302 through the target sighting window 107 to a target 318. When bow 102 is in the drawn position, line of sight 308 may extend through peep sight 304. A compensated targeting axis 310 may correspond to a trajectory of the arrow 104 after release. A ranging module transmit axis 312, may correspond to the beam output from a ranging module (not shown) towards target 318.

The user or operator may adjust the targeting system 200 via the mounting assembly 500 to align the fixed sighting mark 108 such that line of sight is parallel, or coincident, or intersects with at some distance, to the ranging module transmit axis 312 when target window 107 is viewed from a perspective corresponding to eye position 302. The fixed sighting mark 108 may enable a user to ensure that the target 318 being aimed towards from eye position 302 corresponds to the beam output from ranging module (not shown) for accurately ranging a distance to the target 318. The mounting assembly 500 therefore may be operable to be adjusted by the operator to provide this alignment of line of sight 308 and ranging module transmit axis 312. Such proper alignment is confirmed and adjusted as needed during the calibration process.

It is to be understood that FIG. 3 is not drawn to scale, but the compensated targeting axis 310 is generally illustrative of an initial inclination of the trajectory of the arrow 104 after release, and may generally be aligned with (e.g., parallel to) a ranging module transmit axis 312 (discussed below). The arrow 104 may follow a trajectory 320 through the air to a desired point on target 318. For instance, if arrow 104 travels a significant distance from bow 102 to reach a target 318 located at a similar height as bow 102, trajectory 320 may rise to an apex before gravity and air resistance cause the arrow to descend along an approximately parabolic path to the target 318. It should therefore be appreciated that a compensated targeting axis 310 may be raised such that arrow 104 is aiming above the target 318. The compensated targeting axis 310 is the axis in which the arrow 104 travels initially upon leaving the bow 102. For a target 318 located at a similar height to bow 102, the compensated targeting axis 310 may typically be above a target sight line 322 extending from eye position 302 to the target 318, such that (from the operator's perspective) the trajectory 320 of arrow 104 appears to be above the target 318.

In an example embodiment of the disclosure, the processor of the targeting system 200 may present on the target sighting window 107 one or more alignment guidance marks (not shown) to assist a user with orienting the user or bow 102 to bring fixed sighting mark 108 and laser sighting reticle 110 near or closer to each other when target window 107 is viewed from a perspective corresponding to eye position 302. In other words, because an initial orientation of bow 102 relative to a position of the operator's eye 302 may result in the fixed sighting mark 108 not being proximate to the laser sighting reticle 110, the processor of the targeting system 102 may present alignment guidance marks (not shown) indicating the direction in which bow 102 should be moved (oriented) to bring fixed sighting mark 108 and laser sighting reticle 110 near or closer to each other within an alignment region to align targeting system 200 with the user's line of sight 308. The alignment region may represent a general area in which the fixed sighting mark 108 and the laser sighting reticle 110 are projected or presented such that the targeting system 200 aligns with the user's line of sight 308 when viewed from a perspective corresponding to eye position 302. It should be appreciated that the alignment region may not be physically shown on the target sighting window 107. The alignment guidance marks (not shown) may assist a user with orienting himself (his eye position 302) or the bow 102 to which the targeting system 200 is attached to enter a small eye-box or viewing area in proximity of the operator's eye 302 and align fixed sighting mark 108 with laser sighting reticle 110 and thereby confirming that the line of sight 308 is parallel, coincident, or intersects with at some distance, to the ranging module transmit axis 312 when target window 107 is viewed from a perspective corresponding to eye position 302.

The processor may control a projector engine (not shown) and a light array (not shown) to output any combination of the fixed sighting mark 108, laser sighting reticle 110, and alignment guidance marks (not shown). For example, in some embodiments, the projector engine (not shown) may output a holographic image including one or more alignment guidance marks and the laser sighting reticle 110 and the light array (not shown) may output fixed sighting mark 108 such that the fixed sighting mark 108 and the laser sighting reticle 110 are visible within target sighting window 107 from eye position 302. Presentation of the projected first sighting mark 108 or laser sighting reticle 110 may enable a user to range and aim at target 318 without the use of a peep sight 304. As a result, in such embodiments, both the alignment guidance marks (not shown) and the laser sighting reticle 110 may appear to be located closer to target 318 than fixed sighting mark 108 when target window 107 is viewed from a perspective corresponding to eye position 302.

In another example, the projector engine (not shown) may output the laser sighting reticle 110 and the light array (not shown) may output fixed sighting mark 108 and one or more alignment guidance marks (not shown). As a result, in such embodiments, the laser sighting reticle 110 may appear to be located closer to the target 318 than the fixed sighting mark 108 and the alignment guidance marks (not shown) when target window 107 is viewed from a perspective corresponding to the eye position 302.

In another example, the projector engine (not shown) may output the alignment guidance marks (not shown) and the light array (not shown) may output laser sighting reticle 110 and fixed sighting mark 108. As a result, in such embodiments, the alignment guidance marks may appear to be located closer to target 318 than fixed sighting mark 108 and laser sighting reticle 110 when target window 107 is viewed from a perspective corresponding to eye position 302.

Figure 4A:
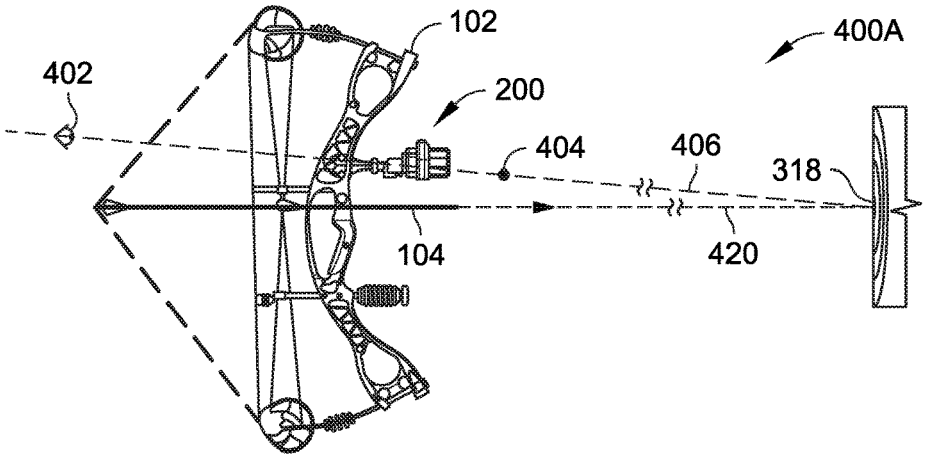
FIG. 4A is an example illustration of a sighting axis and anchor points.

Referring now to FIG. 4A, an example system 400A is illustrated, where the bow 102 is depicted along with a sighting line 406 and the target 318. As described in detailed earlier, the sighting line (line of sight) 406 may extend from a user's eye location 402, through bow sight 105 of the targeting system 200, to the target 318. In other embodiments, the sighting line 406 may extend from a peep sight 304 to the target 318 or the sighting line 406 may extend from a kisser button to the target 318. Fixed sighting mark 108 may be presented on target sighting window 107 such that the fixed sighting mark 108 appears to be projected at a location 404 in front of the bow sight 105 of the targeting system 200 along path 406 to target 318. Fixed sighting mark 108 may alternatively be presented on target sighting window 107 such that the fixed sighting mark 108 is a physical feature on bow sight 105 of the targeting system 200 along path 406 to target 318.

Alignment of the bow 102 to the sighting line 406 may begin with aligning the fixed sighting mark 108 with the line of sight 406. In embodiments, adjustment of the translational block 510 of the bow sight 105 may align the fixed sighting mark 108 with the sighting line 406 and then angular adjustments of the rotational block 520 may align the laser sighting reticle 110 with the line of sight 406. The angular adjustments to the rotational block 520 do not impact the alignment of the fixed sighting mark 108. Thus, adjustments to the translational block 510 are not required after angular adjustments to the rotational block 520.

Figure 4B:
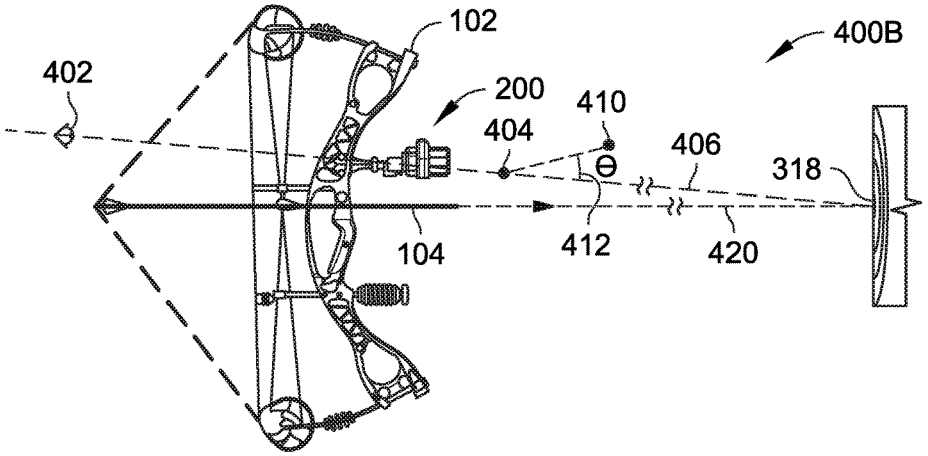
FIG. 4B is an example illustration of a sighting axis and anchor points with a misaligned laser sighting reticle.
Figure 4C:
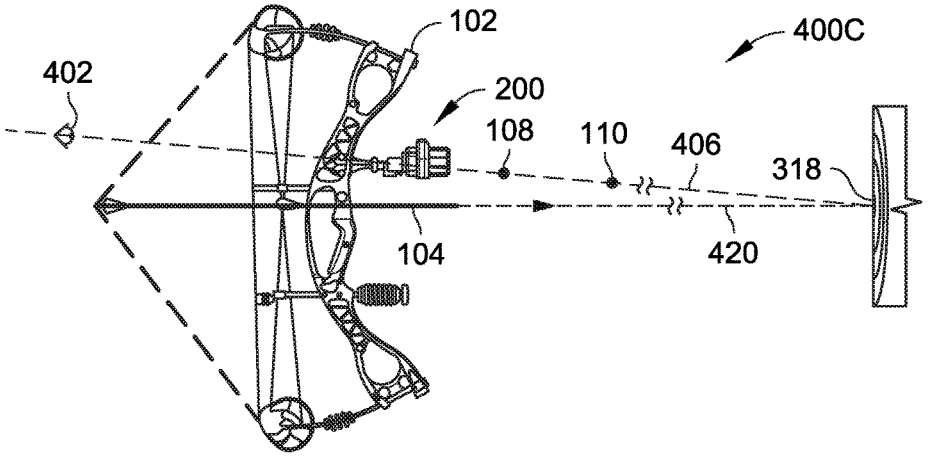
FIG. 4C is an example illustration of a sighting axis and anchor points with an aligned laser sighting reticle.

As indicated in FIG. 4B, adjustments to the translational block 510 to align fixed sighting mark 108 with line of sight 406 may cause fixed sighting marking 108 to appear positioned at location 404. Adjustments to the rotational block 520 may be subsequently made to align the laser sighting reticle 410 along the line of sight 406 to account for a misalignment of an angle θ 412. As an additional example embodiment of the current disclosure, the mounting assembly 500 may decouple the translational adjustments required to align the fixed sighting mark 108 from the rotational adjustments required to align the laser sighting reticle 110 along the sighting line 406. As indicated in FIG. 4C, angular adjustments to the rotational block 520 may align the laser sighting reticle 110 to path 406 corresponding to the sighting line 406. Such angular adjustments to the rotational block 520 may be made without altering the translational adjustments made to align the fixed sighting mark 108, so that the user's eye location 402, the fixed sighting mark 108, and the laser sighting reticle 110 are aligned along the sighting line 406 to target 318 for the user to be able to properly aim towards target 318 for ranging and shooting arrow 104 towards the target 318. It may be appreciated that the adjustments to the bow sight 105 of the targeting system 200 may be performed in any order.

Figure 5:
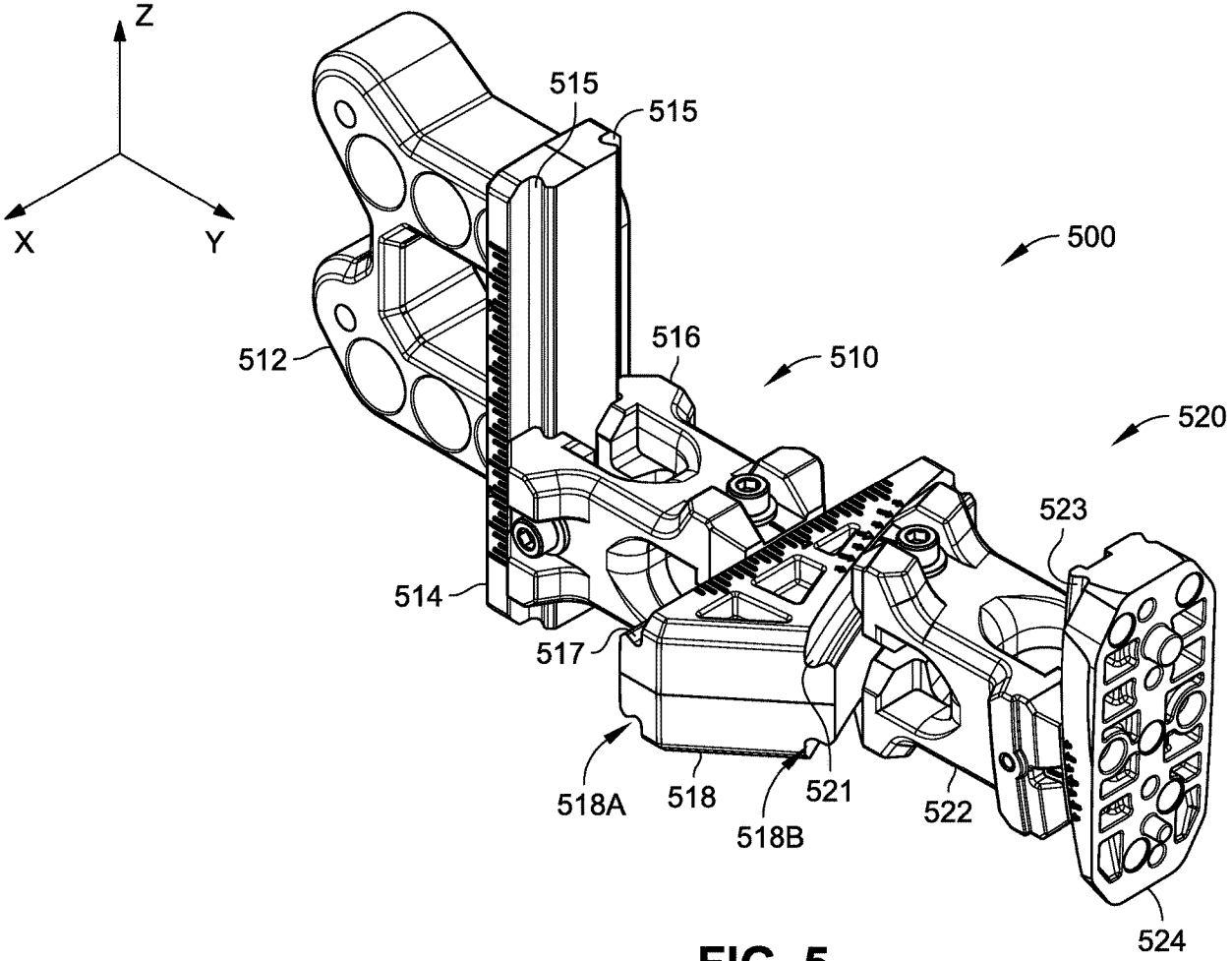
FIG. 5 is an isometric view of an example mounting assembly.
Figure 6:
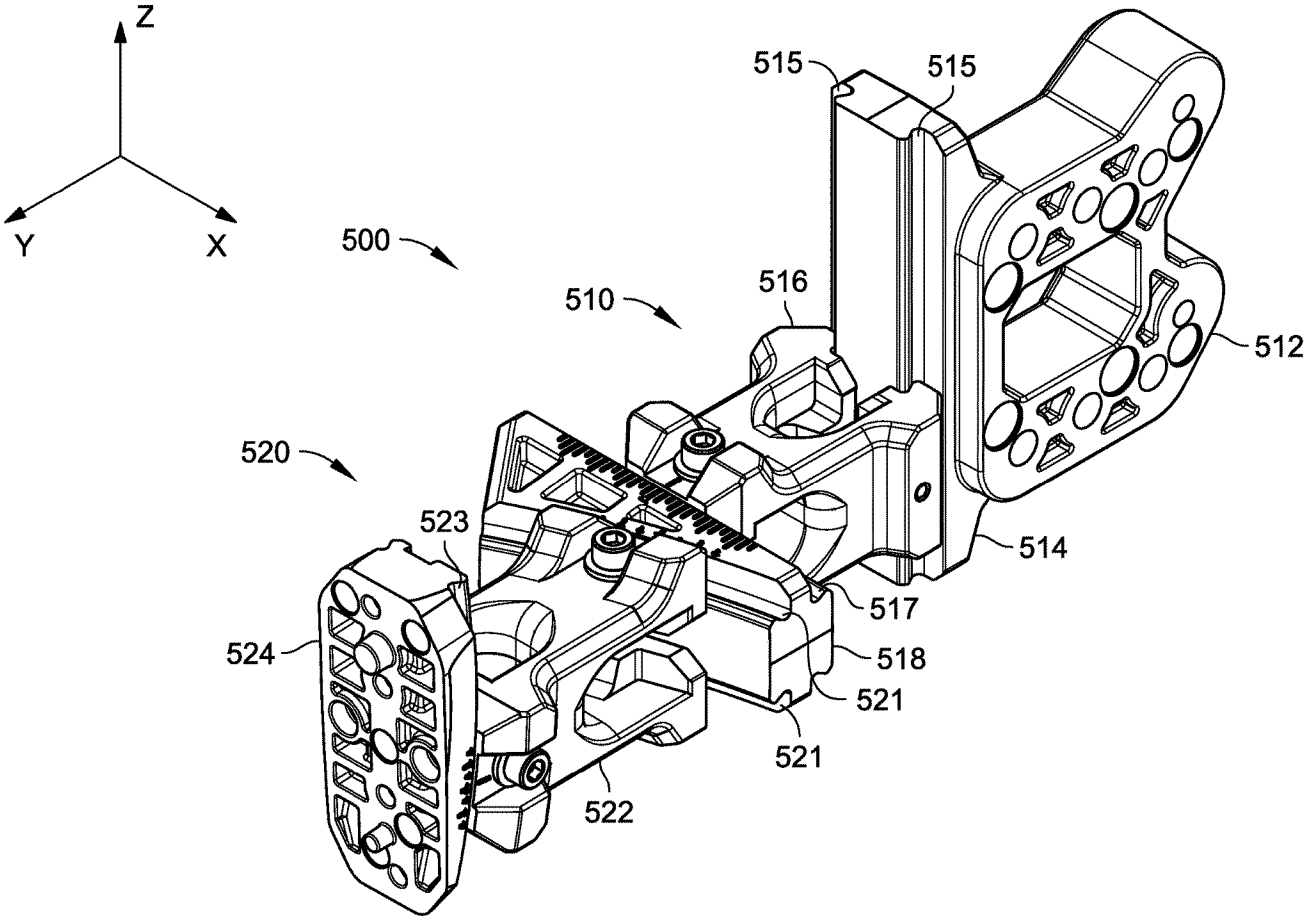
FIG. 6 is another isometric view of the example mounting assembly.
Figure 7:
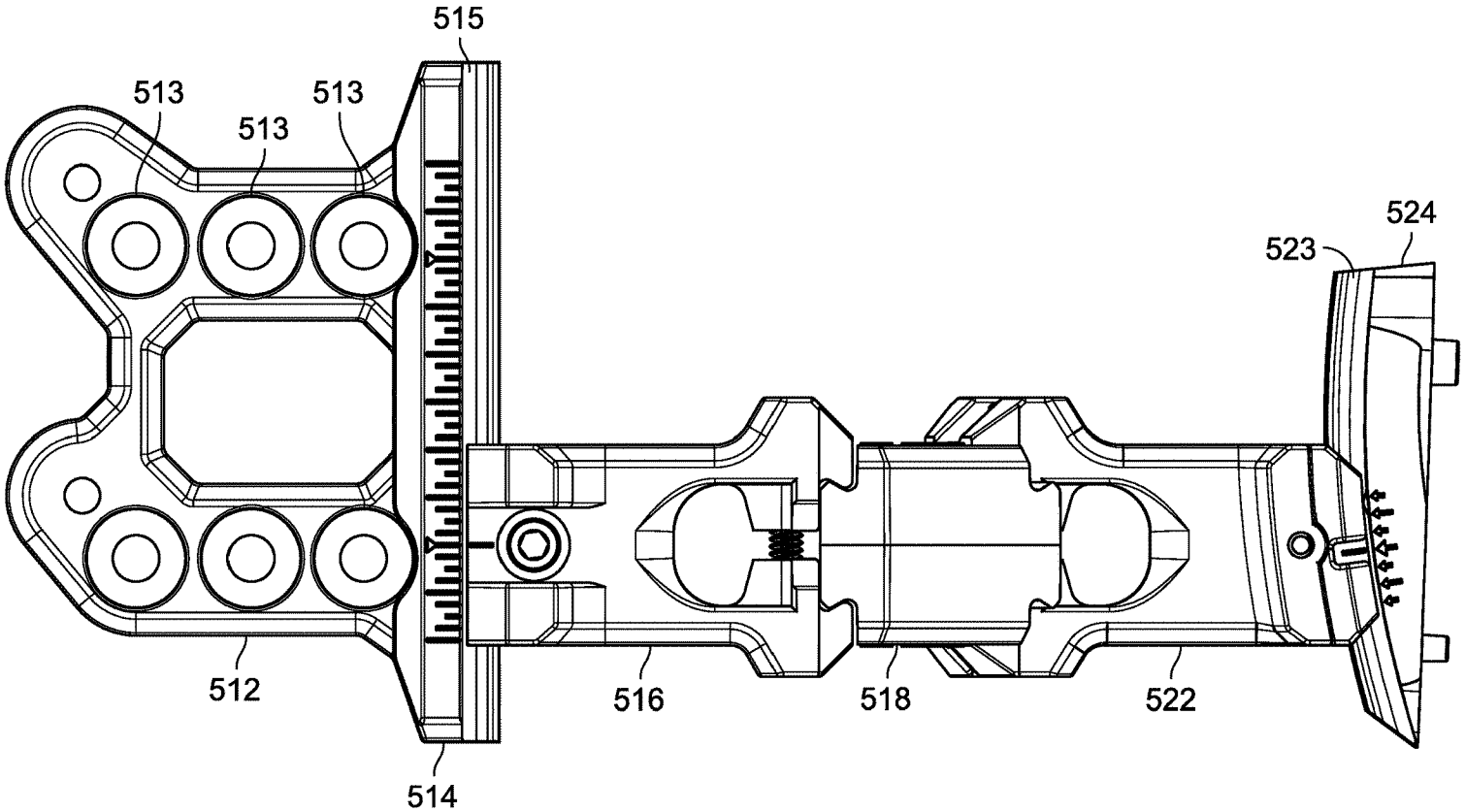
FIG. 7 is a side view of the example mounting assembly.

FIGS. 5-8 show perspective views of the mounting assembly 500 that may be attached to the bow sight 105 of the targeting system 200. In embodiments, the bow sight 105 of the targeting system 200 may project a fixed sighting mark 108 and a laser sighting reticle 110 to enable a user to orient the bow 102 of FIG. 1. As shown in FIGS. 5-7, the mounting assembly 500 may include a mount 512 that may be capable of being attached to a riser of the bow 102. Also illustrated is a translational block 510, which may be coupled to the mount 512, capable of aligning the fixed sighting mark along the sighting line 308. The x, y, and z coordinate axes are indicated for reference in FIGS. 5 and 6. During calibration, translational elements 514 and 518 may be used by the operator/user to align the bow sight 105 and the fixed sighting mark 108 along the sighting line 308. In an alternate example embodiment of the disclosure, the mount 512 may be part of the translational block 510. It is to be understood that each element of the mounting assembly 500 may perform adjustments independent of each other element of the mounting assembly 500. As an example, translational element 514 may perform translational adjustments along the z-axis (first axis of translation) to align the fixed sighting mark 108 along the sighting line 308, independent of all the other elements of the mounting assembly 500. In an example embodiment of the disclosure translational adjustments may first be performed along the y-axis (third axis of translation), and then translational adjustments along the z-axis (first axis of translation), and x-axis (second axis of translation) may be performed in any order.

The translational block 510 may include a first translational element 514 that may be capable of adjusting a location of the bow sight 105, and thus the fixed sighting mark 108, along a z-axis (first axis of translation). As shown in FIGS. 5 and 7, the first translational element 514 may provide adjustments of the bow sight 105 along a groove 515 in a vertical direction (upwards or downwards for a user looking from eye position 302 through the target sighting window 107 to a target 318) that may help align the bow sight 105 and the fixed sighting mark 108 along the sighting line 308. A first adjustment element 516 may enable movement of the bow sight 105 and the fixed sighting mark along groove 515. By way of an example, movement along groove 515 of the translational element 514 may result in movement of elements 516, 518, 522, and 524 along with the attached bow sight 105 along the vertical z-axis (while the location of mount 512 may be fixed relative to the bow 102).

Figure 8:
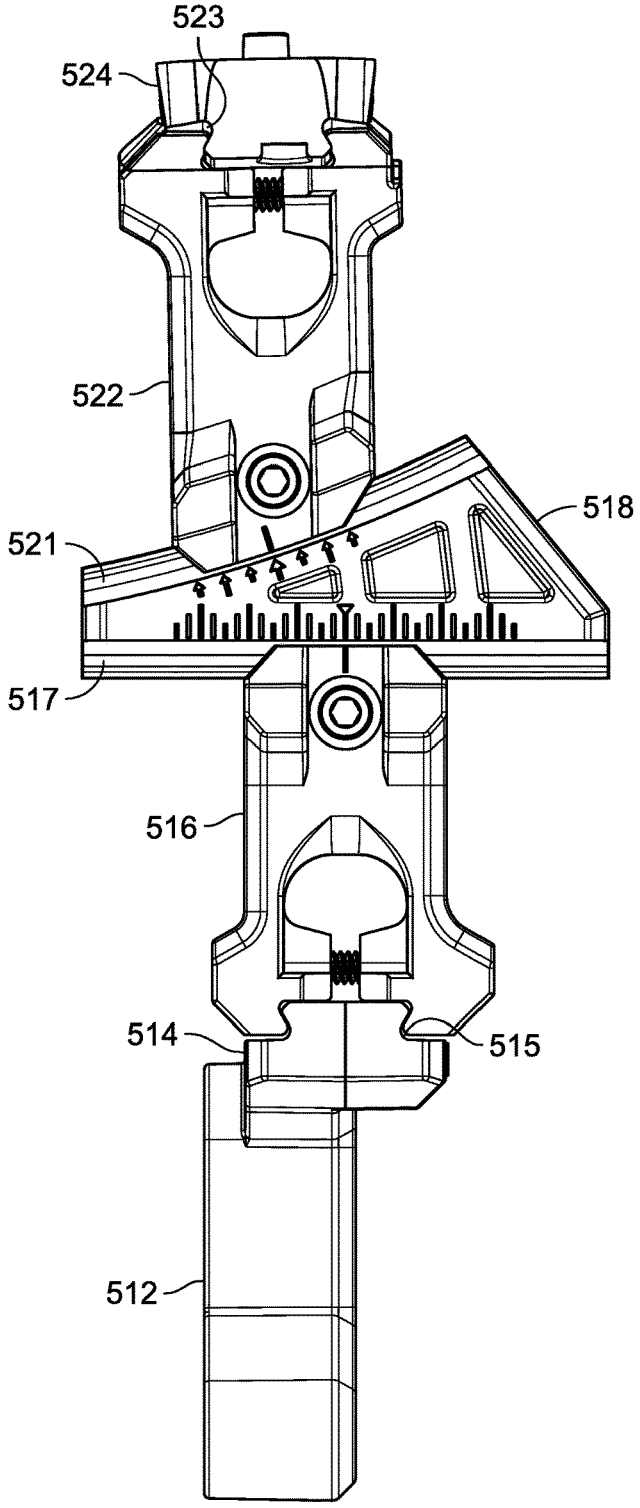
FIG. 8 is a top view of the example mounting assembly.

The translational block 510 may further include a second element 518 that may be capable of adjusting a location of the fixed sighting mark 108 along an x-axis. The second element 518 may be used for both translation and rotation. The second element 518 includes a translational element 518A and a rotational element 518B. The translational element 518A may be an additional example of a second translational element that may be capable of adjusting a location of the bow sight 105 and the fixed sighting mark 108 along the x-axis. As shown in FIGS. 5 and 8, the second translational element 518A may provide adjustments in a horizontal direction (towards the left or right from eye position 302 through the target sighting window 107 to a target 318) that may help align the bow sight 105 and the fixed sighting mark 108 along the sighting line 308. By way of an example, movement along a groove 517 of the translational element 518A may result in movement of 518, 522, and 524 along with the attached bow sight 105 along the horizontal x-axis (while the location of elements 512, 514 and 516 may be fixed relative to the bow 102).

Figure 11:
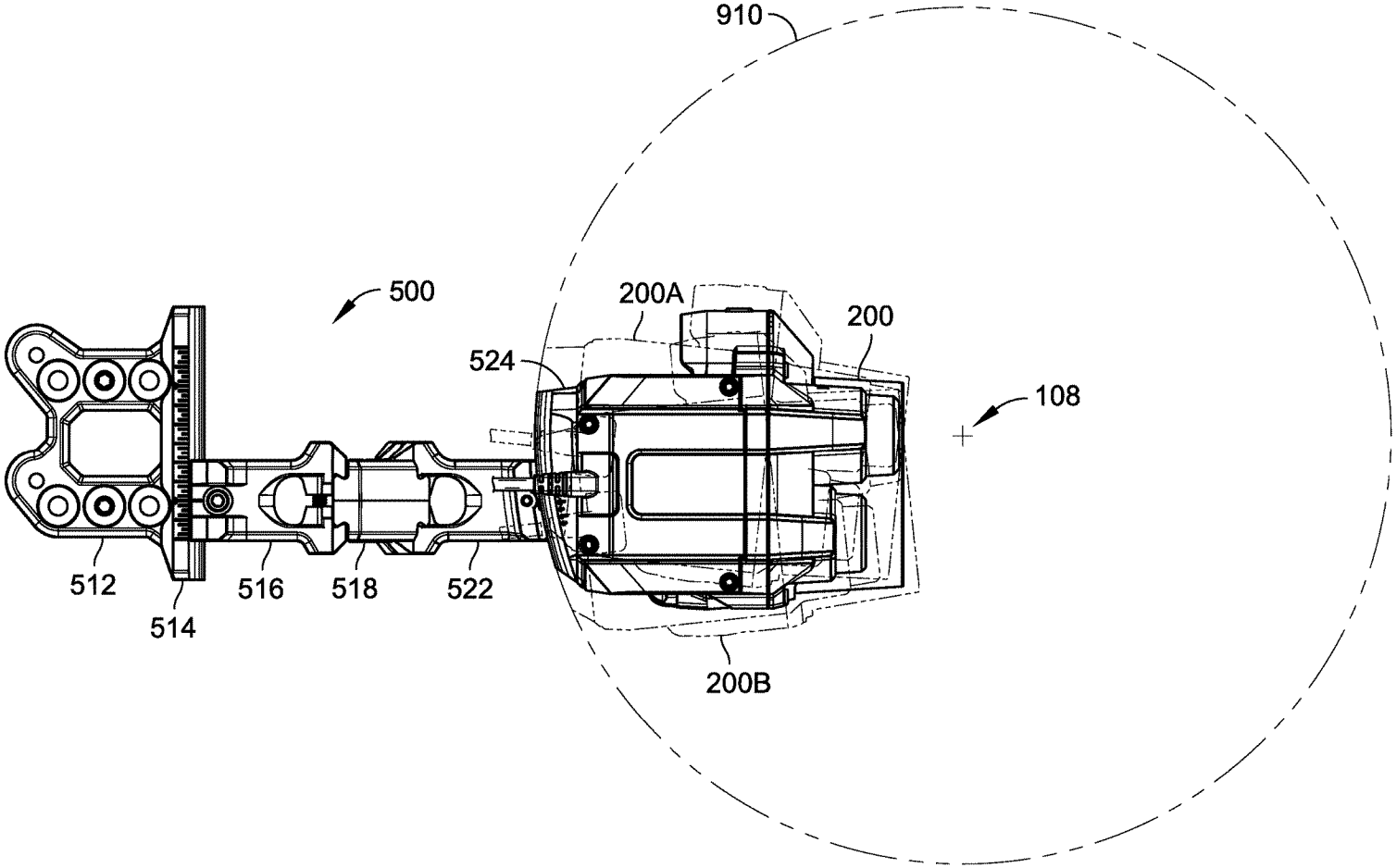
FIG. 11 is a side view of the example mounting assembly and the targeting system with various levels of pitch adjustment.

A rotational block 520 capable of aligning the bow sight 105 and the laser sighting reticle 110 along the sighting line 108 to target 318 is also illustrated in FIGS. 5-8. The rotational block 520 may include a first angular element 524 that may be capable of adjusting a pitch of the bow sight 105 of the targeting system 200 to move a position of the bow sight 105 and the laser sighting reticle 110 about the x axis, as shown in FIG. 11. In embodiments, a center of rotation of the pitch adjustments may be about the projected location of the fixed sighting mark 108. As shown in FIG. 7, the first angular element 524 may include grooves 523 to assist in providing pitch adjustments when mated with notches (not shown) in element 522. A surface of the bow sight 105 may removably attach to a surface of first angular element 524, such as the surface opposing grooves 523.

Figure 12:
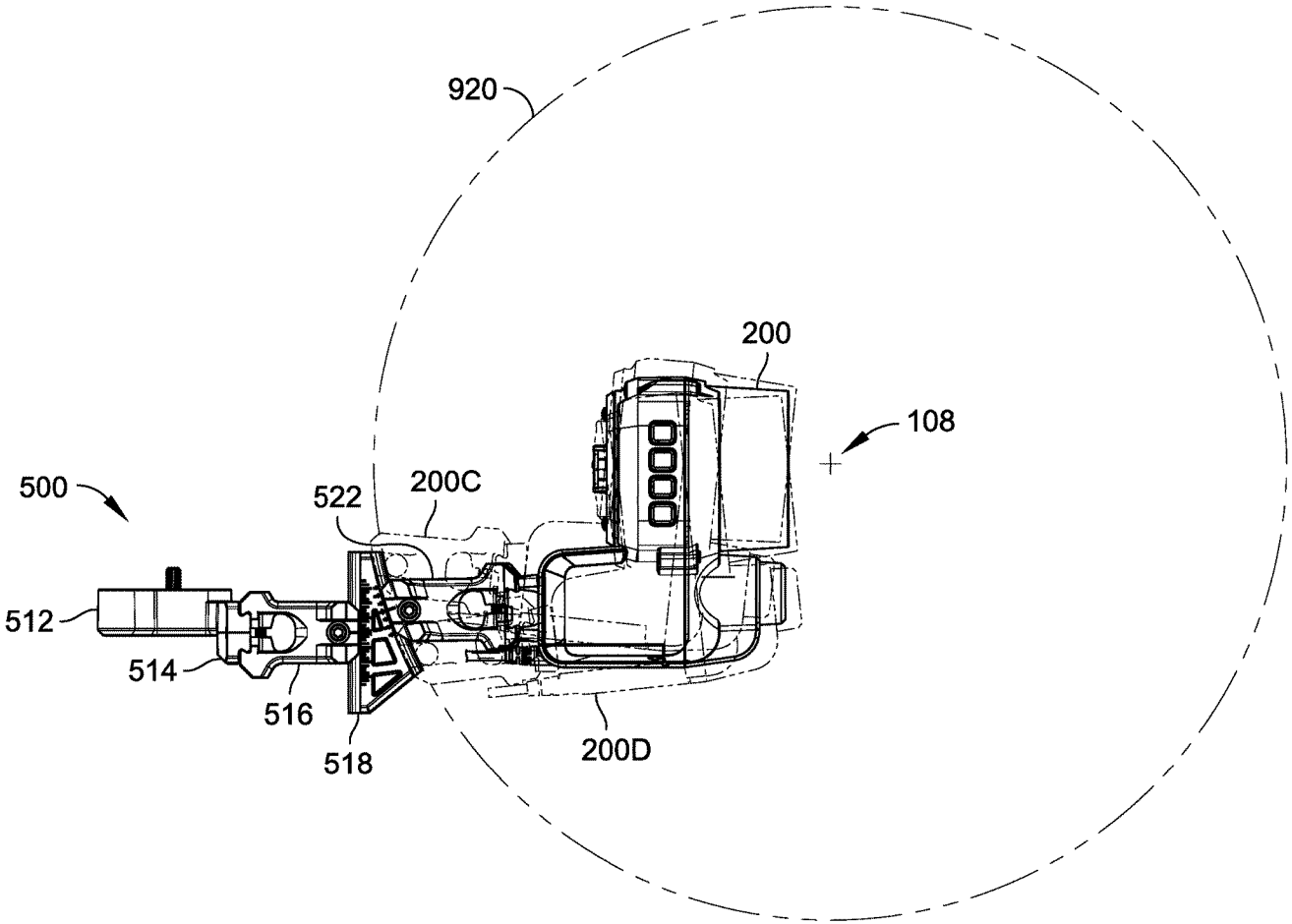
FIG. 12 is a top view of the example mounting assembly and the targeting system with various levels of yaw adjustment.

The rotational block 520 may further include a second angular element that may be capable of adjusting a yaw of the bow sight 105 of the targeting system 200 to move the position of the bow sight 105 and the laser sighting reticle 110 about the z axis, as shown in FIG. 12. Again, a center of rotation of the yaw adjustments may be about the fixed sighting mark 108. In embodiments, as shown in FIGS. 5-8, the second angular element may be integral with the rotational element 518B that may include grooves 517 enabling movement of the bow sight 105 along the x-axis and a second side of the second translational element 518 includes grooves 521 enabling angular movement of the bow sight 105 about the z-axis.

The rotational block 520 may additionally include a third angular element (not shown) that may be capable of adjusting a roll of the bow sight 105 of the targeting system 200 to move the position of the bow sight 105 and the laser sighting reticle 110 about the y axis. Again, a center of rotation of the yaw adjustments may be about the fixed sighting mark 108. In embodiments, rolling the bow sight 105 of the targeting system 200 rotates the bow sight 105 about the y axis.

In an example implementation of the mounting assembly 500, the translational adjustments may be performed by moving the bow sight 105 along grooves 515 and 517 of translational elements 514 and 518, respectively. Then, while keeping a location of elements 512, 514, 516, and 518 fixed in space, a second adjustment element 522 may be used to determine a position of the bow sight 105 about the x axis (pitch adjustment) and about the z axis (yaw adjustment) by selecting a position along a second groove 521 in translational element 518 and a groove 523 in first angular element 524 to move the position of the laser sighting reticle 110 along the sighting line 308. Adjustments to the yaw and pitch of the bow sight 105 may be made by selecting a position of the second adjustment element 522 along grooves 521 and 523, respectively, while keeping a position of all the other elements of the mounting assembly fixed in space.

In embodiments, the translational block 510 is operationally decoupled from the rotational block 520, such that an adjustment of the rotational block 520, for example, an adjustment of the pitch using the groove 523 of second angular element 524 or an adjustment of the yaw using the groove 521 of the second translational element 518, may not change the location of the fixed sighting mark 108. In other words, rotational adjustments performed to align the laser sighting reticle 110 along the sighting line 308 using the elements of the rotational block 520 may not change the location of the fixed sighting mark aligned with the sighting line 308 using the elements of the translational block 510.

In embodiments, one or more elements of the translational block 510 may be physically decoupled from one or more elements of the rotational block 520 such that one or more elements of the rotational block 520 is spaced apart from one or more elements of the translational block 510. As shown in the perspective views of FIGS. 5 and 6, elements of the rotational block 520 may be closer to bow sight 105, whereas elements of the translational block 510 may be closer to the mount 512 attached to the bow 102. As described in detail with regards to FIGS. 4A, 4B, and 4C, the adjustments of the translational block 510 and the rotational block 520 may enable an adjusted location of the fixed sighting mark 108 to be aligned with an adjusted position of the laser sighting reticle 110 along the sighting line 308.

FIGS. 7 and 8 illustrates a side view and a top view of the mounting assembly 500 showing the mount 512, the translational elements 514, 518, rotational element 524, adjustment elements 516, 522, grooves 515, 517, 521 and 523 for making translational and rotational adjustments to the bow sight 105 of the targeting system 200. As shown in FIG. 7, the mount 512 may include holes 513 that provide openings to receive screws or bolts used to properly secure and align the mounting assembly 500 with the riser of a bow 102. The configuration of elements 512, 514, 516, 518, 522 and 524 illustrated in the example embodiments of this disclosure is for illustrative purposes only. The configuration, relative sizes, angles and shape may change depending on the configuration of the projectile weapon and alignment needs.

Figure 9:
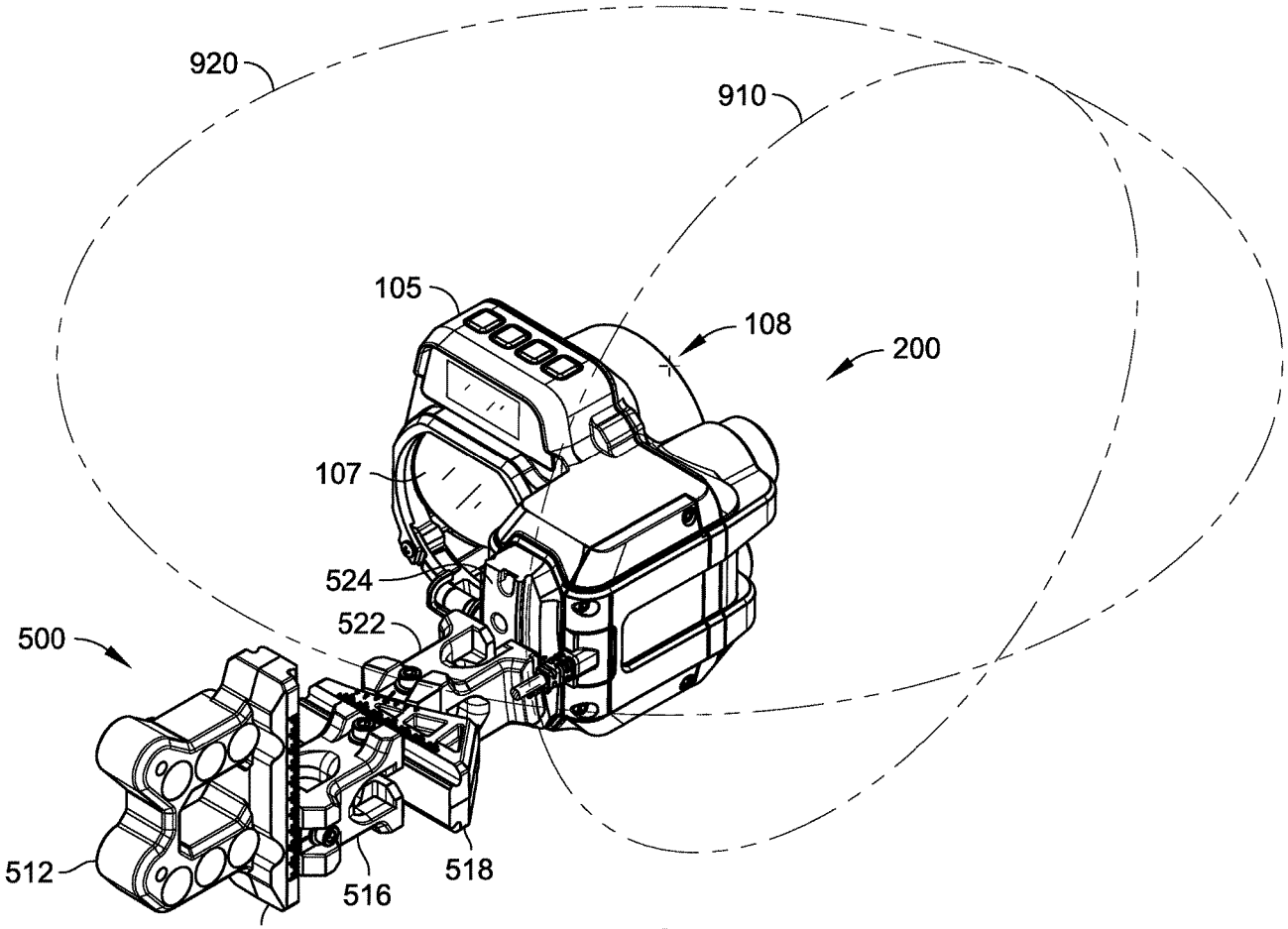
FIG. 9 is an isometric view of the example mounting assembly and the targeting system with rotational circles for angular adjustments.
Figure 10:
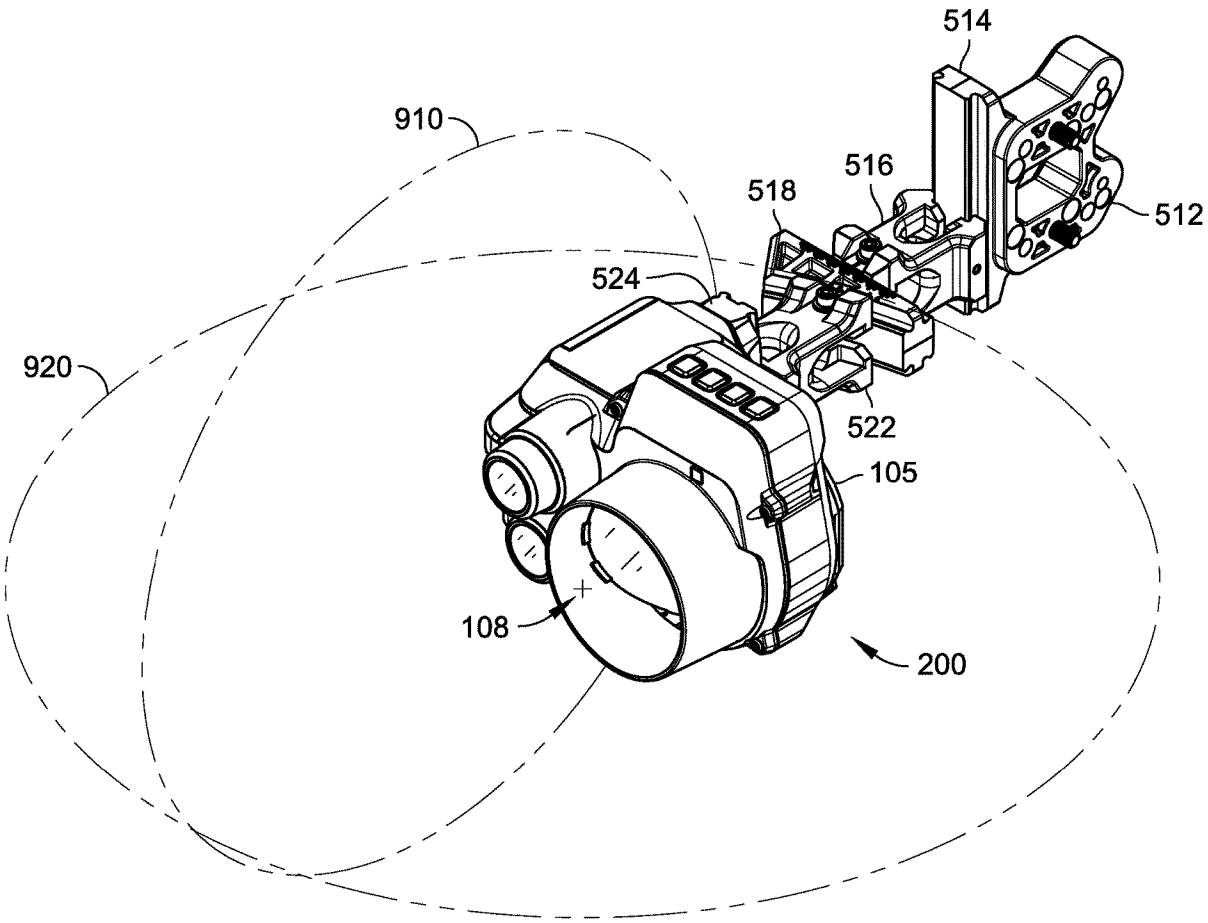
FIG. 10 is another isometric view of the example mounting assembly and the targeting system with rotational circles for angular adjustments.

FIGS. 9 and 10 illustrate isometric views of the mounting assembly 500 integrated with the bow sight 105 of the targeting system 200. Also indicated in FIG. 9 is a projected location of the fixed sighting mark 108 at a distance in front of the bow sight 105. Two circles of rotation 910 and 920 are also illustrated in FIG. 9. The circle of rotation 910 corresponds to a circle of rotation associated with adjustments to the pitch of the bow sight 105 of the targeting system 200, where the center of rotation for the pitch circle 910 is the fixed sighting mark 108. The circle of rotation 910 forms a plane that may be substantially parallel to a y-z plane. The pitch of the bow sight 105 of the targeting system 200 may be adjusted about a x axis to adjust a position of the laser sighting reticle 110. Similarly, a circle of rotation 920 corresponds to a circle of rotation associated with adjustments to the yaw of the bow sight 105 of the targeting system 200, where the center of rotation for the yaw circle 920 is the fixed sighting mark 108. The circle of rotation 920 also forms a plane that is substantially parallel to a x-y plane. The yaw of the bow sight 105 of the targeting system 200 may be adjusted about a z axis to adjust a position of the laser sighting reticle 110.

FIG. 11 illustrates a side view of targeting system 200 attached to the mounting assembly 500 with example pitch operation accomplished by moving the position of the bow sight 105 along groove 523. Solid lines show a neutral position of the targeting system 200 where the pitch is at zero degrees. Phantom lines showing a rotated position of the targeting system 200 show various pitching angles. By way of example, the targeting system may move to a position as shown by phantom lines indicated in 200A due to a pitch of +6 degrees. By way of another example, the targeting system may move to a position as shown by phantom lines indicated in 200B due to a pitch of −6 degrees. In other embodiments, the value of the pitch adjustment may vary and may not be symmetrical about a central axis of the mounting assembly 500. As described earlier, the center of rotation of the pitch circle 910 is the fixed sighting mark 108. Since the targeting system 200 and hence the bow sight 105 is rotated about the fixed sighting mark 108, the alignment of the fixed sighting mark 105 established by performing translational adjustments of the mounting assembly 500 does not change during rotational pitch adjustments.

FIG. 12 illustrates a top view of targeting system 200 attached to the mounting assembly 500 with example yaw operation accomplished by moving the position of the bow sight 105 along groove 521. Solid lines show a neutral position of the targeting system 200 where the yaw is at zero degrees. Phantom lines showing a rotated position of the targeting system 200 show various yaw angles. By way of an example, the targeting system may move to a position as shown by phantom lines indicated in 200C due to a yaw angle of +6 degrees. By way of another example, the targeting system may move to a position as shown by phantom lines indicated in 200D due to a yaw of −6 degrees. In other example embodiments, the value of the yaw adjustments may vary and may not be symmetrical about a central axis of the mounting assembly 500. As described earlier, the center of rotation of the yaw circle 920 is the fixed sighting mark 108. Since the targeting system 200 and hence the bow sight 105 is rotated about the fixed sighting mark 108, the alignment of the fixed sighting mark 105 established by performing translational adjustments of the mounting assembly 500 does not change during rotational yaw adjustments.

Figure 13B:
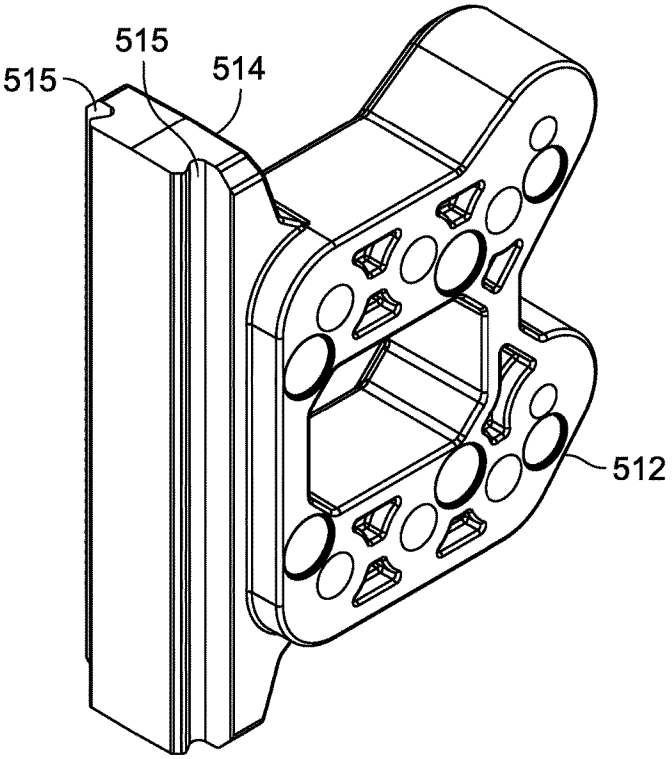
FIG. 13A and FIG. 13B are exploded isometric views of an example transitional element.
Figure 13A:
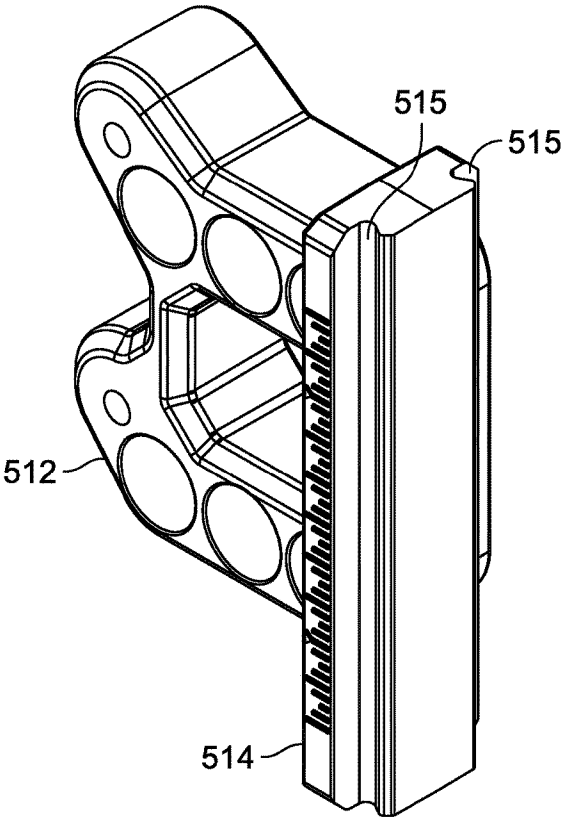

FIG. 13A and FIG. 13B illustrate exploded isometric part views of the mount 512 and the translational element 514 along with the groove 515 that may be used to make translational adjustments along the z-axis in order to orient the targeting system 200 to align the fixed sighting mark 108 along the sighting line 308. As shown in FIG. 13A, the translational element 514 may have graduated measurements to implement accurate adjustments along the z-axis, based on instructions received at the targeting system 200.

Figure 14B:
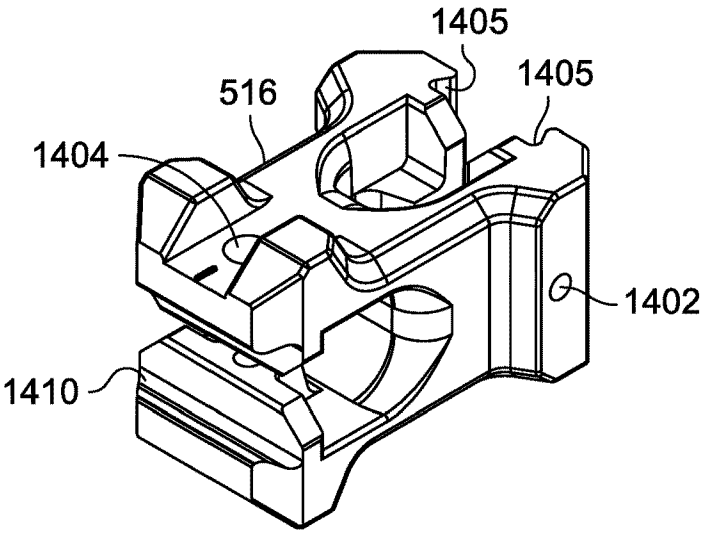
FIG. 14A and FIG. 14B are exploded isometric views of an example transitional element.
Figure 14A:
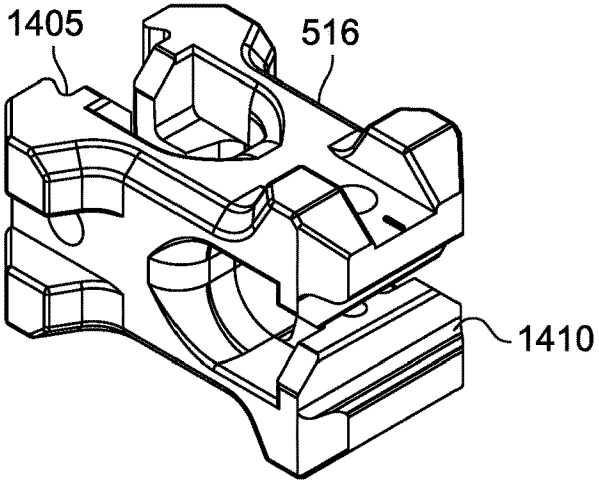

FIG. 14A and FIG. 14B illustrate exploded isometric part views of the first adjustment element 516 along with notches 1405 that may mate with grooves 515 of first translational element 514 that may be used to make translational adjustments along the z-axis in order to orient the targeting system 200 to align the fixed sighting mark 108 along the sighting line 308. Also shown are notches 1410 that may mate with grooves 517 of the second translational element 518 that may be used to make translational adjustments along the x-axis in order to orient the targeting system 200 to align the fixed sighting mark 108 along the sighting axis 308. FIG. 14B also shows location of screw adjustment screw ports 1402 and 1404 that may receive screws that may be loosened to perform translational adjustments respectively along the z-axis and the x-axis and tightened to secure the adjustments.

Figure 15B:
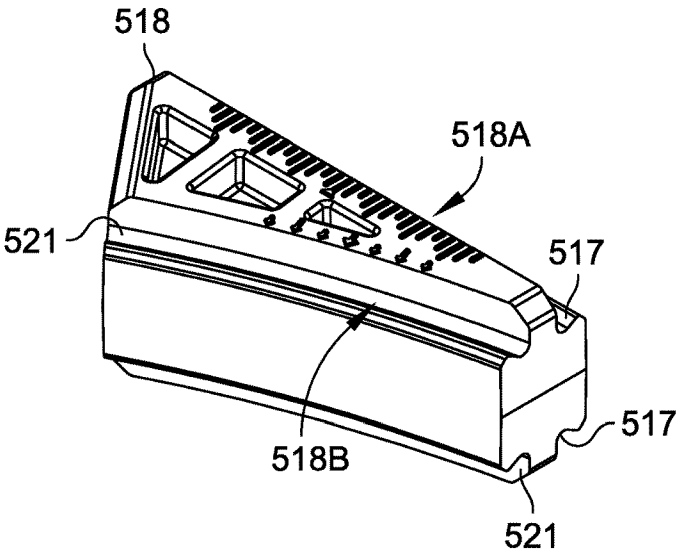
FIG. 15A and FIG. 15B are exploded isometric views of an example element used for both transition and rotation.
Figure 15A:
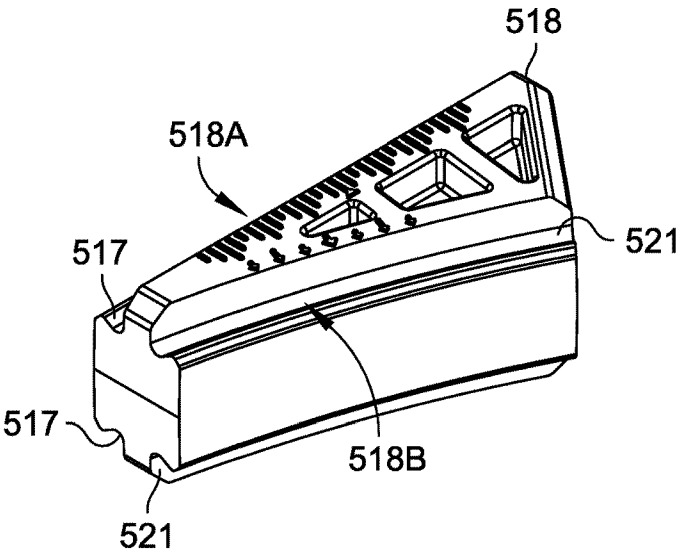

FIG. 15A and FIG. 15B illustrate exploded isometric part views of the translational/rotational element 518 that may include translational element 518A including groove 517 to make translational adjustments along the x-axis and rotational element 518B including groove 521 to make rotational yaw adjustments about the z-axis. As shown in FIG. 15A, the translational element 518A may have grooves 517 that may mate with notch 1410 of first adjustment element 516 for performing translational adjustments along the x-axis (side to side adjustments). Additionally, the element 518B may also have grooves 521 that may mate with notch 1605 of second adjustment element 522 about the z axis (illustrated in FIGS. 16A and 16B). As shown in FIG. 15A and FIG. 15B, the translational element 518A may have graduated measurements at the translation end to implement accurate adjustments along the x-axis to align the fixed sighting mark 108 along the sighting line 308, based on instructions received at the targeting system 200. Additionally, the rotational element 518B may have graduated measurements to implement fine adjustments about the z axis to align the laser sighting reticle 110 along the sighting line 308, based on instructions received at the targeting system 200.

Figure 16B:
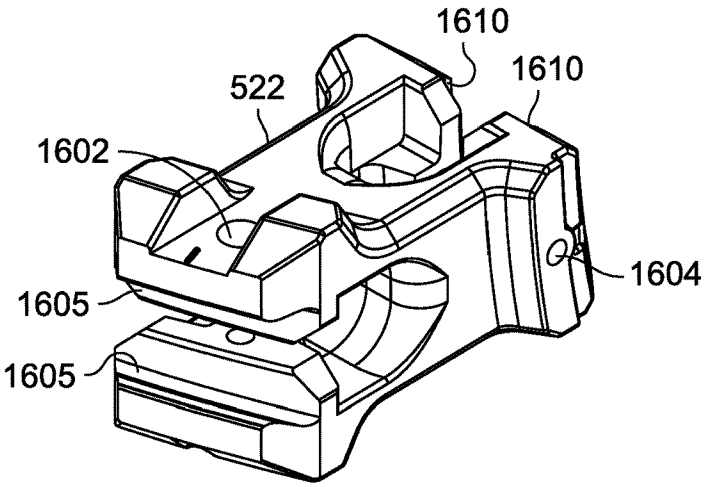
FIG. 16A and FIG. 16B are exploded isometric views of an example rotational element.
Figure 16A:
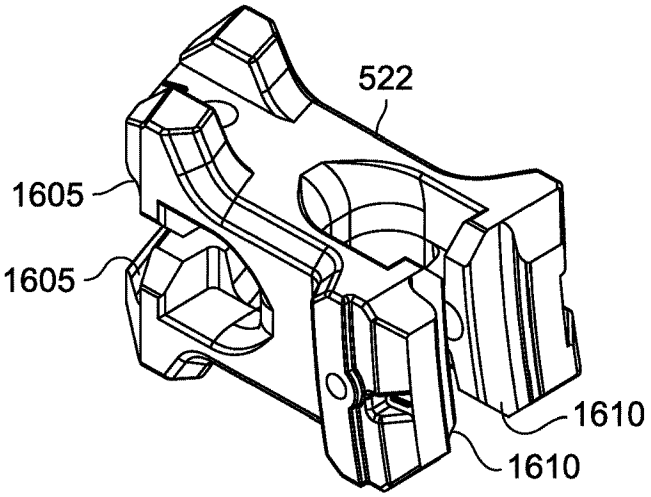

FIG. 16A and FIG. 16B illustrate exploded isometric part views of the rotational second adjustment element 522 along with notches 1605 that may mate with grooves 521 of second translational element 518 that may be used to make rotational yaw adjustments in order to orient the targeting system 200 to align the laser sighting reticle 110 along the sighting line 308. Also shown are notches 1610 that may mate with grooves 523 of the first angular element 524 that may be used to make rotational pitch adjustments along in order to orient the targeting system 200 to align the laser sighting reticle 110 along the sighting axis 308. FIG. 16B also shows location of screw adjustment screw ports 1602 and 1604 that may receive screws that may be loosened to perform rotational yaw and pitch adjustments, respectively, and tightened to secure the adjustments.

Figure 17B:
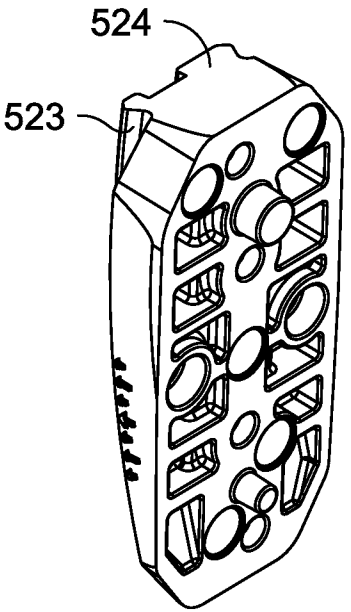
FIG. 17A and FIG. 17B are exploded isometric views of an example rotational element.
Figure 17A:
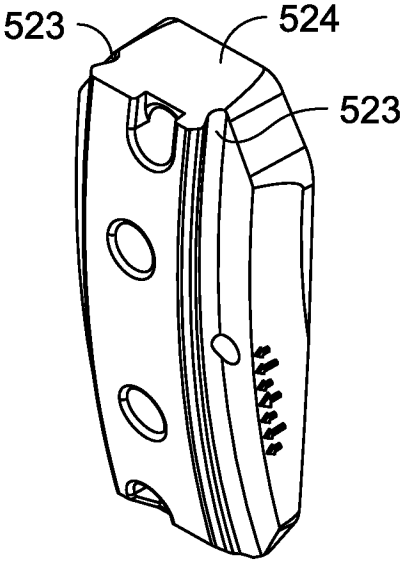

FIG. 17A and FIG. 17B illustrate exploded isometric part views of the rotational first angular element 524 along with the groove 523 that mates with the notch 1610 that may allow the mounting assembly 500 to make pitch adjustments to align the laser sighting reticle 110 along the sighting line 308. Also shown in FIGS. 17A and 17B are mounting holes that may be used to attach the bow sight 105 to the mounting assembly 500.

Figure 18:
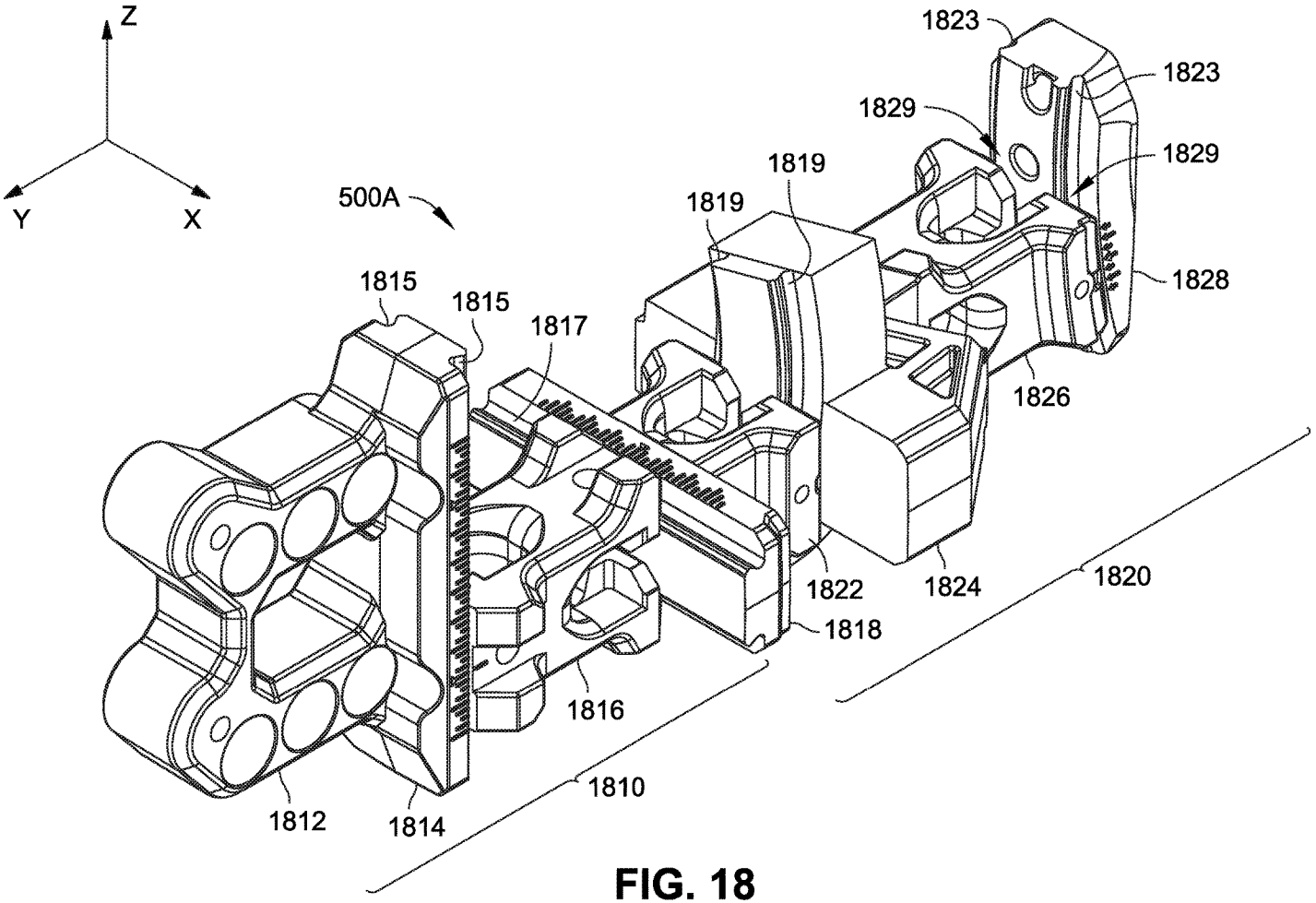
FIG. 18 is an isometric view of an example mounting assembly.
Figure 19:
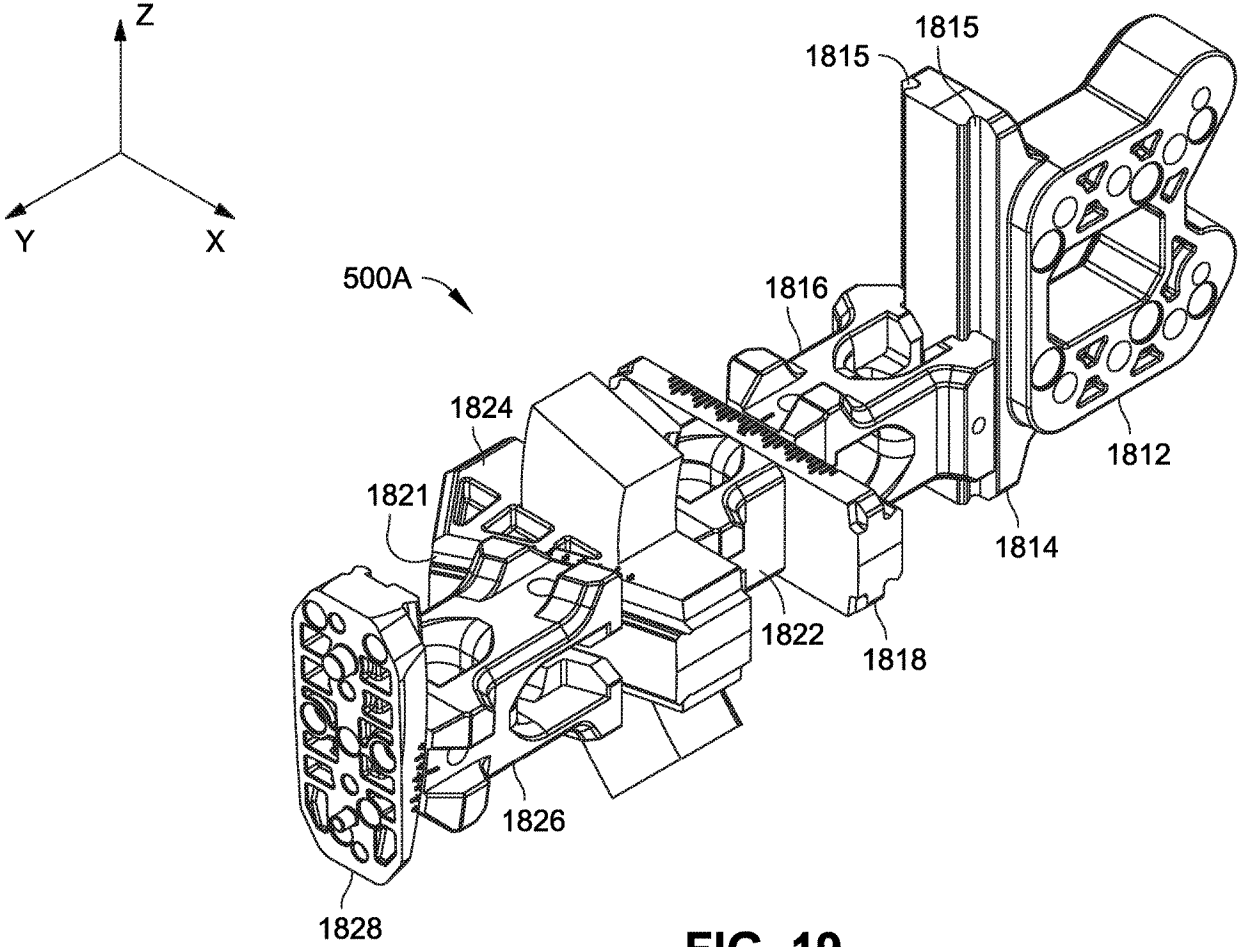
FIG. 19 is another isometric view of the example mounting assembly of FIG. 18.

Referring now to FIGS. 18-19, according to an example embodiment of the disclosure, a perspective view of a mounting assembly 500A that may be attached to the bow sight 105 of the targeting system 200. As described earlier, the bow sight 105 of the targeting system 200 may project a fixed sighting mark 108 and a laser sighting reticle 110 to orient the bow 102 of FIG. 1 for aiming towards a target. The mounting assembly 500A includes a mount 1812 that may be capable of being attached to a riser of the bow 102. Also, the mounting assembly 500A may be attached at the other end, namely the end with an element 1828, to a bow sight 105 of the targeting system 200. Also illustrated is a translational block 1810 (similar to translational block 510 of FIG. 5) that may be coupled to the mount 1812 which may be capable of aligning the fixed sighting mark along the sighting line 308. The translational block 1810 may include a first translational element 1814 that may be capable of adjusting a location of the bow sight 105 and the fixed sighting mark 108 along a z-axis. As shown in FIG. 18, the first translational element 1814 may provide adjustments in a vertical direction (upwards or downwards for a user looking from eye position 302 through the target sighting window 107 to a target 318) that may help align the bow sight 105 and the fixed sighting mark 108 along the sighting line 308. By way of an example, the translational element 1814 may enable elements 1816, 1818, 1822, 1824, 1826, and 1828 along with the attached bow sight 105 of the targeting system 200 to be adjusted in the vertical z-axis along a groove 1815 in the first translational element 1814. The translational block 1810 may further include a second translational element, such as the element 1818, that may be capable of adjusting a location of the bow sight 105 and the fixed sighting mark 108 along an x-axis. As shown in FIGS. 18-19, the second translational element 1818 may provide adjustments in a horizontal direction (towards the left or right for a user looking from eye position 302 through the target sighting window 107 to a target 318) that may help align the bow sight 105 and the fixed sighting mark 108 along the sighting line 308. Similar to the first adjustment element 516, a first adjustment element 1816 may enable movement of the bow sight 105 and the fixed sighting mark along grooves 1815 and 1817.

By way of an example, a location of the elements 1812, 1814 and 1816 may be fixed while elements 1818, 1822, 1824, 1826, and 1828 along with the attached bow sight 105 of the targeting system 200 may be adjusted in the horizontal x-axis along a groove 1817 in the translational element 1818 to align a location of the fixed sighting mark 108 along the sighting line 308. Alternatively, a location of the elements 1818, 1822, 1824, 1826, and 1828 along with the attached bow sight 105 of the targeting system 200 may be fixed, while the elements 1812, 1814, and 1816 are adjusted along the groove 1817 illustrated in element 1818 in the horizontal x-axis to align a location of the fixed sighting mark 108 along the sighting line 308. The x, y, and z coordinate axes are indicated for reference in FIGS. 18-19. During calibration, translational elements 1814, 1816, and/or 1818 may be used by the operator/user to align the bow sight 105 and the fixed sighting mark 108 along the sighting line 308. In an alternate example embodiment of the disclosure, the element 1812 may be part of the translational block 1810.

Referring again to FIGS. 18-19, a rotational block 1820 is also illustrated. The rotational block 1820 may be capable of aligning the bow sight 105 and the laser sighting reticle 110 along the sighting line 108. The rotational block 1820 may further include a first angular element 1828, similar to first angular element 524, that may be capable of adjusting a pitch of the bow sight 105 of the targeting system 200 to move a position of the laser sighting reticle 110 about the x axis. In an example embodiment of the disclosure, a center of rotation of the pitch may be the fixed sighting mark 108, as shown in FIG. 11. As shown in FIG. 18, the first angular element 1828 may include grooves 1823 to assist in providing pitch adjustments when mated with notches 1829 in second adjustment element 1826.

The rotational block 1820 may further include a second angular element that may be capable of adjusting a yaw of the bow sight 105 of the targeting system 200 to move the position of the bow sight 105 and the laser sighting reticle 110 about the z axis. Similar to the second adjustment element 522, the second adjustment element 1826 may be used to determine a position of the bow sight 105 along the x axis (pitch adjustment) and the z axis (yaw adjustment) by selecting a position along a groove 1823 in first angular element 1828 and a second groove 1821 in a second angular element 1824, respectively, to move the position of the laser sighting reticle 110 along the sighting line 308. Again, a center of rotation of the yaw may be the fixed sighting mark 108, as shown in FIG. 12.

The rotational block 1820 may additionally include a third adjustment element 1822, which couples with the second angular element 1824, that may be capable of adjusting a roll of the bow sight 105 of the targeting system 200 to move the position of the laser sighting reticle 110 about the y axis. In an example embodiment of the disclosure, rolling the bow sight 105 of the targeting system 200 via the second angular element 1824 along a groove 1819 rotates the bow sight 105 away from the riser of the bow 102. In another example embodiment of the disclosure, each element of the mounting assembly 500A may perform adjustments independent of each other element of the mounting assembly 500A. As an example, translational adjustments along the y-axis may be performed first, and then translational element 1814 may perform translational adjustments along the z-axis to align the fixed sighting mark 108 along the sighting line 308, independent of all the other elements of the mounting assembly 500A. Translational element 1816 or 1818 may then be used to perform additional translational adjustments along the x-axis.

In an example implementation of the mounting assembly 500A, the translational adjustments may be first performed using the translational elements 1814 and 1818. Then, while keeping a location of elements 1812, 1814, 1816, and 1818 fixed in space, the third adjustment element 1822 along with the attached elements 1824, 1826, 1828 and the bow sight 105 of the targeting system 200 may be adjusted along the groove 1819 in second angular element 1824 to adjust the roll of the bow sight 105 of the targeting system 200 to move the position of the laser sighting reticle 110 along the sighting line 308. Adjustments to the pitch of the bow sight 105 of the targeting system 200 may be made using the first angular element 1828 while keeping a position of all the other elements of the mounting assembly fixed in space. This may be accomplished by adjusting the element 1828 along a groove 1823 in the element 1828. Yaw adjustments may be made by keeping a location of elements 1812, 1814, 1816, 1818 and 1812 fixed in space, the second adjustment element 1826 along with the attached elements 1828 and the bow sight 105 of the targeting system 200 may be adjusted along the groove 1821 in element 1824 to adjust the yaw of the bow sight 105 of the targeting system 200 to move the position of the laser sighting reticle 110 along the sighting line 308.

In an example embodiment of the disclosure, the translational block 1810 is operationally decoupled from the rotational block 1820, such that an adjustment of the rotational block 1820, for example, an adjustment of the yaw using the second angular element 1826 or an adjustment of the pitch using the first angular element 1828, may not change the location of the fixed sighting mark 108 along the first axis of translation and the second axis of translation (not shown). In other words, rotational adjustments that may be performed to align the laser sighting reticle 110 along the sighting line 308 using the elements of the rotational block 1820 may not change the location of the fixed sighting mark aligned with the sighting line 308 using the elements of the translational block 1810.

As indicated in the example mount assembly 500A of FIGS. 18-19, in another example embodiment of the disclosure, the one or more elements of the translational block 1810 may be physically decoupled from one or more elements of the rotational block 1820 such that one or more elements of the rotational block 1820 is spaced apart from the one or more elements of the translational block 1810. As shown in the perspective view of FIGS. 18-19, elements of the rotational block 1820 may be closer to bow sight 105 of the targeting system 200, whereas elements of the translational block 1810 may be closer to the mount attached to the bow 102. As described in detail with regards to FIGS. 4A, 4B, and 4C, the adjustments of the translational block 510 and the rotational block 520 may enable an adjusted location of the fixed sighting mark 108 to be aligned with an adjusted position of the laser sighting reticle 110 along the sighting line 308.

Figure 20:
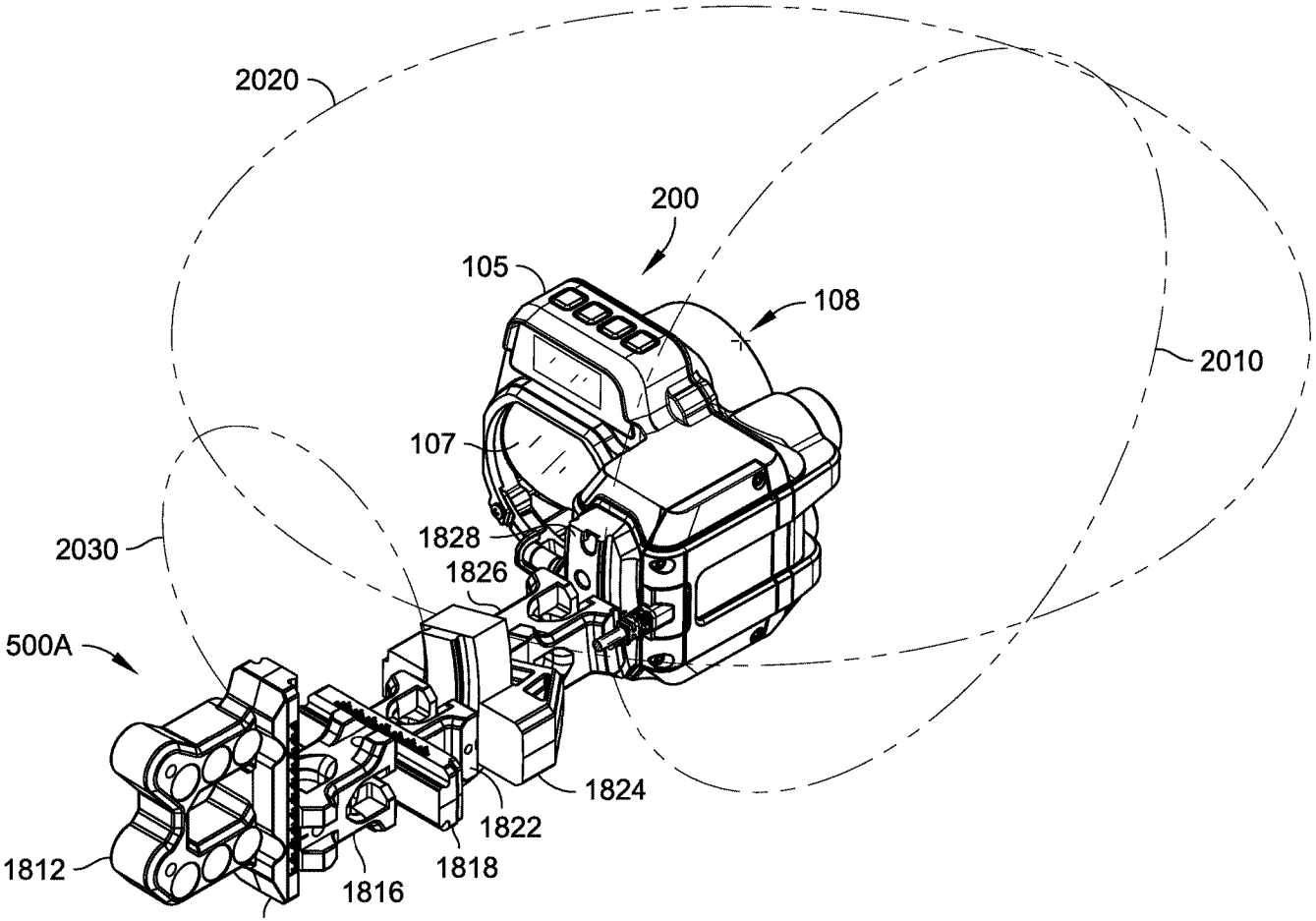
FIG. 20 is an isometric view of the example mounting assembly of FIG. 18 and the targeting system with rotational circles for angular adjustments.
Figure 21:
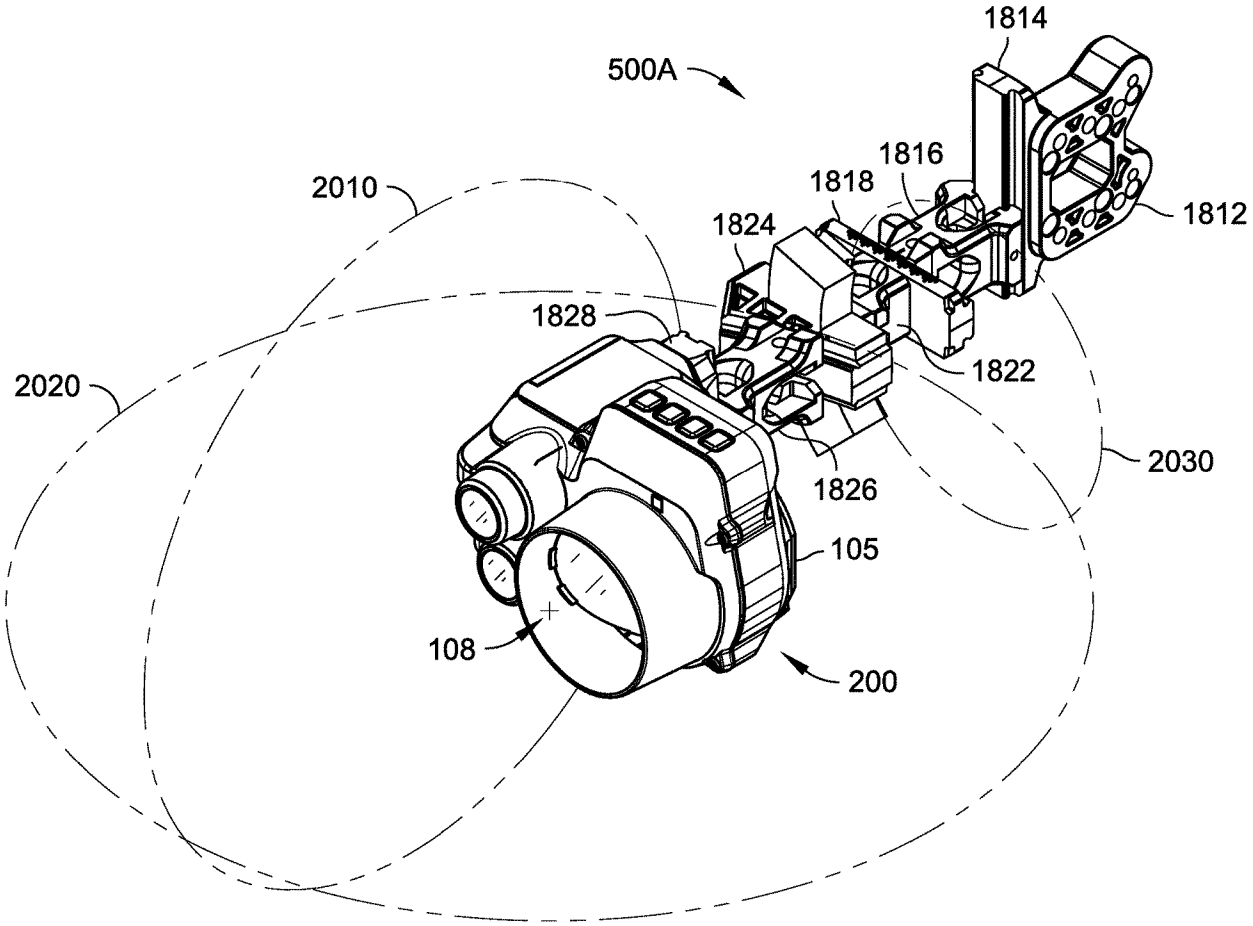
FIG. 21 is another isometric view of the example mounting assembly of FIG. 18 and the targeting system with rotational circles for angular adjustments.

FIGS. 20 and 21 illustrate isometric views of the mounting assembly 500A integrated with the bow sight 105 of the targeting system 200. Also indicated in FIG. 20 is a projected location of the fixed sighting mark at a distance in front of the bow sight 105. Three circles of rotation 2010, 2020 and 2030 are also illustrated in FIG. 20. The circle of rotation 2010 corresponds to a circle of rotation associated with adjustments to the pitch of the bow sight 105 of the targeting system 200, where the center of rotation for the pitch circle 2010 is the fixed sighting mark 108. The circle of rotation 2010 forms a plane that may be substantially parallel to a y-z plane. The pitch of the bow sight 105 of the targeting system 200 may be adjusted by rotating about the x axis to adjust a position of the laser sighting reticle 110. Similarly, a circle of rotation 2020 corresponds to a circle of rotation associated with adjustments to the yaw of the bow sight 105 of the targeting system 200, where the center of rotation for the yaw circle 2020 is the fixed sighting mark 108. The circle of rotation 2020 also forms a plane that is substantially parallel to a x-y plane. The yaw of the bow sight 105 may be adjusted by rotating about the z axis to select a position of the laser sighting reticle 110. A third circle of rotation 2030 corresponds to a circle of rotation associated with adjustments to the roll of the bow sight 105 of the targeting system 200, where the center of rotation for the roll circle 2030 is the fixed sighting mark 108. The circle of rotation 2030 also forms a plane that is substantially parallel to a x-z plane. The roll of the bow sight 105 of the targeting system 200 may be adjusted by rotating about a y axis to adjust a position of the laser sighting reticle 110. Pitch and yaw adjustments of the mounting assembly 500A are similar to those described in FIG. 11 and FIG. 12 corresponding to mounting assembly 500.

Figure 22:
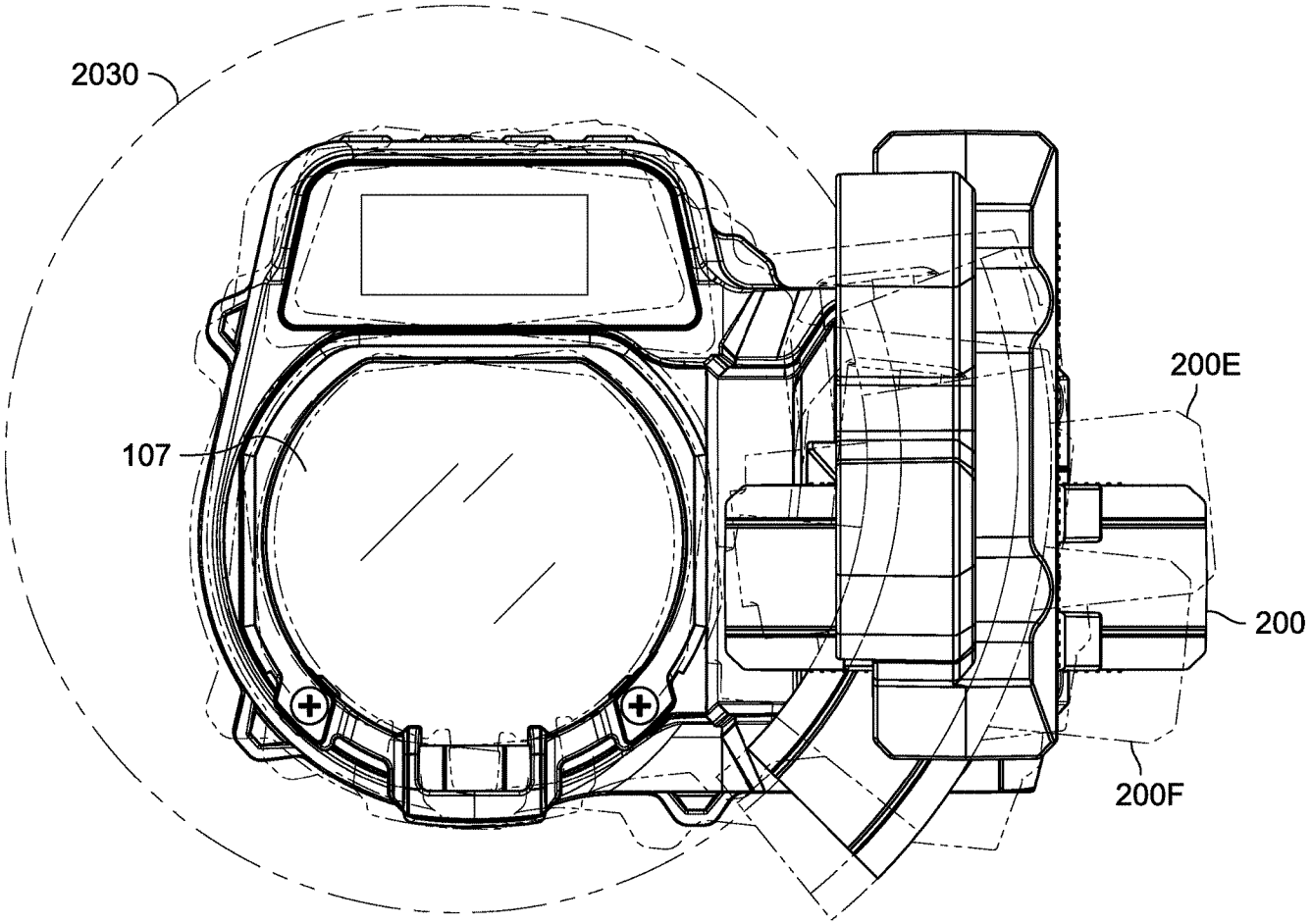
FIG. 22 is an end view of the example mounting assembly of FIG. 18 and the targeting system with various levels of roll adjustment.

Referring now to FIG. 22, illustrated is an end view of targeting system 200 attached to the mounting assembly 500A with example roll operations using the adjustment elements 1822 and 1824. Solid lines show a neutral position of the targeting system 200 where the roll is at zero degrees. Phantom lines showing a rotated position of the targeting system 200 show various roll angles. By way of an example, the targeting system may move to a position as shown by phantom lines indicated in 200E due to a roll of +6 degrees. By way of another example, the targeting system may move to a position as shown by phantom lines indicated in 200F due to a roll of −6 degrees. In other example embodiments, the value of the roll adjustment may vary and may not be symmetrical about a central axis of the mounting assembly 500A. As described earlier, the center of rotation of the roll circle 2030 is the fixed sighting mark 108. Since the targeting system 200 and hence the bow sight 105 is rotated about the fixed sighting mark 108, the alignment of the fixed sighting mark 105 established by performing translational adjustments of the mounting assembly 500A does not change during rotational pitch adjustments.

Figure 23A:
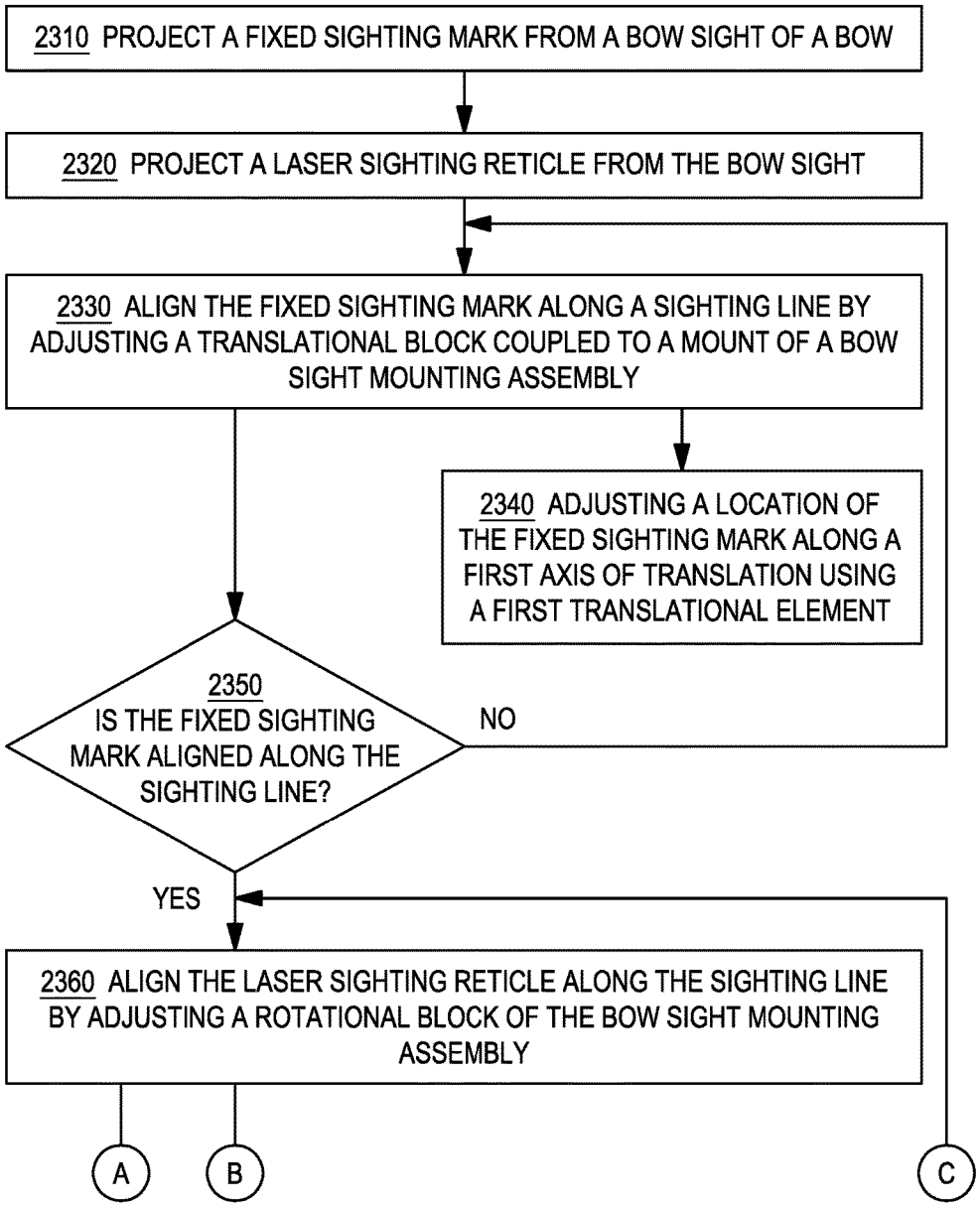
FIGS. 23A and 23B illustrate a block flow diagram illustrating exemplary steps performed by a user.
Figure 23B:
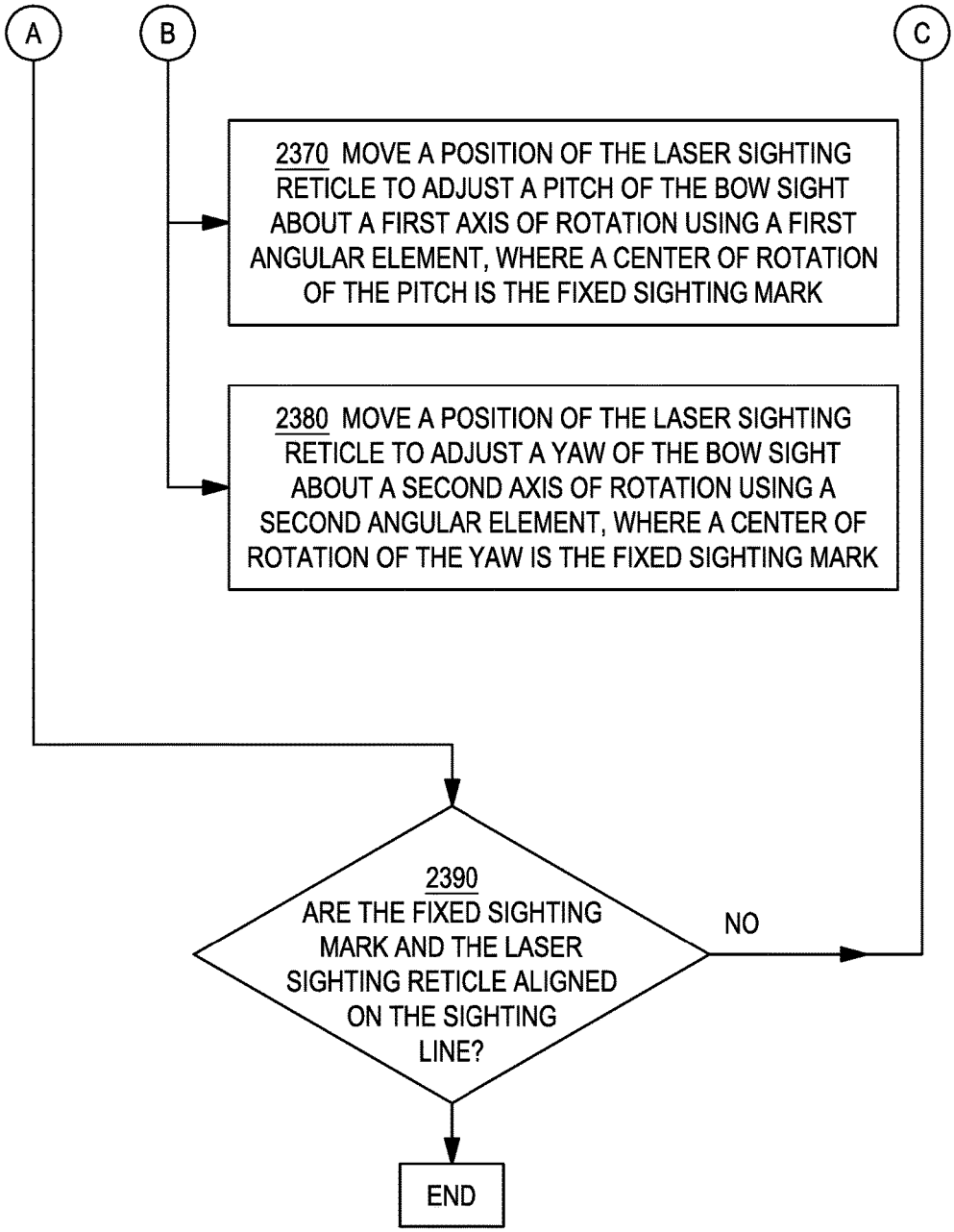
Figure 24:
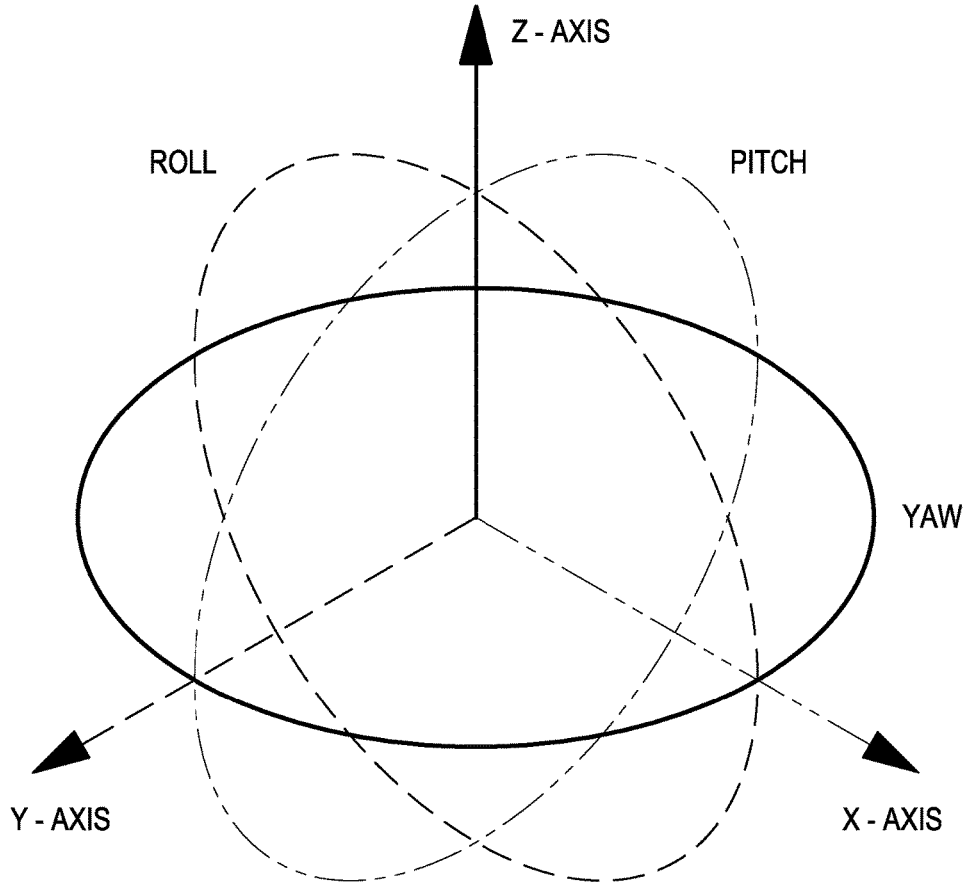
FIG. 24 illustrates translational and rotational component axes of an example mounting assembly.

FIGS. 23A and 23B illustrate an example process 2300 that employs a mounting assembly 500 for orienting a bow sight 105 of a bow 102. In general, operations of disclosed processes (e.g., process 2300) may be performed in an arbitrary order, unless otherwise provided in the claims. The mounting assembly 500 may be coupled to the bow 102 using a mount and may include a translational block 510 and a rotational block 520 that may be decoupled from each other such that adjustments made to the rotational block 520 to align the laser sighting reticle 110 may not modify the adjustments made to the translational block 510 to align the fixed sighting mark 108.

In an implementation of the process 2300 of orienting a bow 102, a fixed sighting mark 108 may be projected 2310 on a transparent or semi-transparent target sighting window 107 to appear as being located at a position in front of a bow sight 105 of a targeting system 200 of the bow 102. The sighting mark could also be a physical item such as an etch, paint, or fiber optic. Additionally, a laser sighting reticle 110 may be projected 2320 on the transparent or semi-transparent target sighting window 107 to appear as being located at a position in front of or behind (at a different distance than the sighting mark) the bow sight 105 of the targeting system 200. The method 2300 may further include aligning 2330 the fixed sighting mark 108 along a sighting line 308 by adjusting 2340 a translational block 510 coupled to a mount of a bow sight 105 mounting assembly 500 by moving the bow sight 105 laterally (along an x-axis) or vertically (along a z-axis).

If the fixed sighting mark is aligned along the sighting line 308, the process 2300 may further proceed by aligning 2360 the laser sighting reticle 110 along the sighting line 308 by way of adjusting a rotational block 520 of the bow sight 105 mounting assembly 500. Adjusting the rotational block 520 may further involve moving 2370 a position of the laser sighting reticle 110 to adjust a pitch of the bow sight 105 of the targeting system 200 about a first axis of rotation using a first angular element 522, where the center of rotation of the pitch is the fixed sighting mark 108. Adjusting the rotational block may further involve moving 2380 a position of the laser sighting reticle 110 to adjust a yaw of the bow sight 105 of the targeting system 200 about a second axis of rotation using a second angular adjustment 524, where the center of rotation of the yaw is the fixed sighting mark 108. The process ends by verifying 2390 that the fixed sighting mark 108 and the laser sighting reticle 110 align on the sighting line 308 extending from a user's eye location 402, through bow sight 105 of the targeting system 200, to the target 318.

CONCLUSION

It should be also appreciated that while the disclosure herein refers to bows and other low-velocity projectile weapons, embodiments of the disclosure may be utilized with other types of weapons. In some exemplary embodiments of the disclosure, the positioning device interacts with a firearm, a grenade launcher, artillery and other large projectile weapons, a missile, a rocket, a torpedo, or a weapon associated with a vehicle (such as an aircraft, a ship, a tank, an armored personnel carrier, a mobile artillery piece, or the like). It should therefore be noted that throughout the description, "bow" may be replaced by "projectile weapon" or any of the above-mentioned examples; "arrow" may be replaced by "projectile" or any projectile associated with the above-mentioned examples; and "operator" could be replaced with "user," "hunter," "gunner," "shooter," "driver," or the like.

It should be understood that the above detailed description is to be construed as exemplary only and does not describe every possible embodiment since describing every possible embodiment would be impractical. In light of the teachings and disclosures herein, numerous other embodiments may be implemented.

Although the technology has been described with reference to the embodiments illustrated in the attached drawing figures, equivalents may be employed, and substitutions made herein without departing from the scope of the technology as recited in the claims. Components illustrated and described herein are merely examples of a device and components that may be used to implement the embodiments of the present disclosure and may be replaced with other devices and components without departing from the scope of the disclosure.

What is claimed is:

1. An assembly for mounting a bow sight to a bow, the bow sight projecting a fixed sighting mark and a laser sighting reticle aligned to orient the bow, the assembly comprising:

a mount operable to attach to a riser of the bow;

a translational block coupled to the mount and operable to align the fixed sighting mark along a sighting line, the translational block comprising:

a first translational element operable to adjust a location of the fixed sighting mark along a first axis of translation; and a rotational block operable to align the laser sighting reticle along the sighting line, the rotational block comprising:

a first angular element operable to adjust a pitch of the bow sight to move a position of the laser sighting reticle about a first axis of rotation, wherein a center of rotation of the pitch is the fixed sighting mark; and a second angular element operable to adjust a yaw of the bow sight to move the position of the laser sighting reticle about a second axis of rotation, wherein a center of rotation of the yaw is the fixed sighting mark.

2. The assembly of claim 1, wherein the translational block further comprises a second translational element operable to adjust the location of the fixed sighting mark along a second axis of translation.

3. The assembly of claim 1, wherein the rotational block further comprises: a third angular element operable to adjust a roll of the bow sight to move the position of the laser sighting reticle about a third axis of rotation, wherein a center of rotation of the roll is the fixed sighting mark.

4. The assembly of claim 1, wherein the translational block is operationally decoupled from the rotational block so that an adjustment of the rotational block does not change the location of the fixed sighting mark along the first axis of translation and the second axis of translation.

5. The assembly of claim 1, wherein the one or more elements of the translational block is physically decoupled from one or more elements of the rotational block so that the one or more elements of the rotational block is spaced apart from the one or more elements of the translational block.

6. The assembly of claim 1, wherein an adjusted location of the fixed sighting mark aligns with an adjusted position of the laser sighting reticle along the sighting line.

7. The assembly of claim 1, wherein the sighting line extends from one of: a user's eye to a target, a peep sight to a target or a kisser button to a target.

8. A method of orienting a bow, the method comprising:

projecting a fixed sighting mark from a bow sight of the bow;

projecting a laser sighting reticle from the bow sight;

aligning the fixed sighting mark along a sighting line, wherein aligning the fixed sighting mark comprises adjusting a translational block coupled to a mount of a bow sight mounting assembly, adjusting the translational block comprising:

adjusting a location of the fixed sighting mark along a first axis of translation using a first translational element;

verifying that the fixed sighting mark is aligned along the sighting line;

aligning the laser sighting reticle along the sighting line, wherein aligning the laser sighting reticle comprises adjusting a rotational block of the bow sight mounting assembly, adjusting the rotational block comprising:

moving a position of the laser sighting reticle to adjust a pitch of the bow sight about a first axis of rotation using a first angular element, wherein a center of rotation of the pitch is the fixed sighting mark;

moving a position of the laser sighting reticle to adjust a yaw of the bow sight about a second axis of rotation using a second angular element, wherein a center of rotation of the yaw is the fixed sighting mark; and verifying that the fixed sighting mark and the laser sighting reticle align on the sighting line.

9. The method of claim 8, wherein adjusting the translational block further comprises: adjusting a location of the fixed sighting mark along a second axis of translation using a second translational element.

10. The method of claim 8, wherein adjusting the rotational block further comprises: moving a position of the laser sighting reticle to adjust a roll of the bow sight about a third axis of rotation using a third angular element, wherein a center of rotation of the roll is the fixed sighting mark.

11. The method of claim 8, wherein the translational block is operationally decoupled from the rotational block so that adjusting the rotational block does not change the location of the fixed sighting mark along the first axis of translation and the second axis of translation.

12. The method of claim 8, wherein the one or more elements of the translational block is physically decoupled from one or more elements of the rotational block so that the one or more elements of the rotational block is spaced apart from the one or more elements of the translational block.

13. The method of claim 8, wherein an adjusted location of the fixed sighting mark aligns with an adjusted position of the laser sighting reticle along the sighting line.

14. The method of claim 8, wherein the sighting line extends from one of: a user's eye to a target, a peep sight to a target or a kisser button to a target.

15. A system comprising:

a bow sight attached to a bow, the bow sight projecting a fixed sighting mark and a laser sighting reticle; and an assembly for mounting the bow sight to the bow, the assembly comprising:

a mount operable to attach to a riser of the bow;

a translational block coupled to the mount and operable to align the fixed sighting mark along a sighting line, the translational block comprising:

a first translational element operable to adjust the location of the fixed sighting mark along a first axis of translation; and a rotational block operable to align the laser sighting reticle along the sighting line, the rotational block comprising:

a first angular element operable to adjust a pitch of the bow sight to move a position of the laser sighting reticle about a first axis of rotation, wherein a center of rotation of the pitch is the fixed sighting mark; and a second angular element operable to adjust a yaw of the bow sight to move the position of the laser sighting reticle about a second axis of rotation, wherein a center of rotation of the yaw is the fixed sighting mark;

wherein the translational block is operationally decoupled from the rotational block so that an adjustment of the rotational block does not change the location of the fixed sighting mark along the first axis of translation and a second axis of translation.

16. The system of claim 15, wherein the translational block further comprises a second translational element operable to adjust the location of the fixed sighting mark along the second axis of translation.

17. The system of claim 15, wherein the rotational block further comprises: a third angular element operable to adjust a roll of the bow sight to move the position of the laser sighting reticle about a third axis of rotation, wherein a center of rotation of the roll is the fixed sighting mark.

18. The system of claim 15, wherein the one or more elements of the translational block is physically decoupled from one or more elements of the rotational block so that the one or more elements of the rotational block is spaced apart from the one or more elements of the translational block.

19. The system of claim 15, wherein an adjusted location of the fixed sighting mark aligns with an adjusted position of the laser sighting reticle along the sighting line.

20. The system of claim 15, wherein the sighting line extends from one of: a user's eye to a target, a peep sight to a target or a kisser button to a target.

* * * * *